US008678375B2

(12) United States Patent
Hanamoto

(10) Patent No.: US 8,678,375 B2
(45) Date of Patent: Mar. 25, 2014

(54) SHEET FEEDER FOR FEEDING SHEET AND IMAGE PROCESSING APPARATUS WITH SHEET FEEDER

(71) Applicant: Kyocera Document Solutions Inc., Osaka (JP)

(72) Inventor: Katsuhiko Hanamoto, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/705,458

(22) Filed: Dec. 5, 2012

(65) Prior Publication Data

US 2013/0147107 A1 Jun. 13, 2013

(30) Foreign Application Priority Data

Dec. 9, 2011 (JP) ..... 2011-270404

(51) Int. Cl.
*B65H 3/06* (2006.01)

(52) U.S. Cl.
USPC ..... 271/118; 271/117

(58) Field of Classification Search
USPC ..... 271/117, 118
See application file for complete search history.

(56) References Cited

U.S. PATENT DOCUMENTS

| | | | | |
|---|---|---|---|---|
| 5,462,267 | A * | 10/1995 | Hori | 271/10.04 |
| 6,554,270 | B2 * | 4/2003 | Yamamoto | 271/117 |
| 2005/0158091 | A1 * | 7/2005 | Oya et al. | 399/367 |
| 2008/0019747 | A1 * | 1/2008 | Lee | 399/367 |
| 2009/0040572 | A1 | 2/2009 | Shimmachi et al. | |

FOREIGN PATENT DOCUMENTS

| | | |
|---|---|---|
| EP | 1215536 | 6/2002 |
| JP | 2009-44605 | 2/2009 |

* cited by examiner

*Primary Examiner* — Prasad Gokhale
(74) *Attorney, Agent, or Firm* — Gerald E. Hespos; Michael J. Porco; Matthew T. Hespos

(57) ABSTRACT

A sheet feeder includes a sheet placing portion, a feeding member, a supporting body, a driver, an electromagnetic clutch and a retraction controller. The supporting body is capable of changing a posture between a sheet feeding posture of the feeding member and a retracting posture for retracting the feeding member. The electromagnetic clutch is capable of changing a state between an engaged state in which a drive force is transmitted to the supporting body and a disengaged state in which the drive force is not transmitted to the supporting body. The retraction controller stops the output of a drive force after the electromagnetic clutch is set in the engaged state and the supporting body is set to the retracting posture by the drive force, and sets the electromagnetic clutch in the disengaged state when an engagement keeping time elapses after the output of the drive force is stopped.

7 Claims, 16 Drawing Sheets

SHEET FEEDER FOR FEEDING SHEET AND IMAGE PROCESSING APPARATUS WITH SHEET FEEDER

This application is based on Japanese Patent Application Ser. No. 2011-270404 filed with the Japan Patent Office on Dec. 9, 2011, the contents of which are hereby incorporated by reference.

BACKGROUND

The present disclosure relates to a sheet feeder for picking up and feeding sheets one by one and an image processing apparatus using this sheet feeder.

Conventionally, there is known an auto document feeder (ADF) applied to an image processing apparatus such as a copier or a facsimile machine. This auto document feeder includes a document tray on which a stack of documents is placed and a pickup roller for successively picking up the documents on this document tray from the uppermost one and feeding them into a feeder main body. A document image reading process is successively applied to each sheet for the documents fed by the pickup roller.

To pick up the documents by the pickup roller, the pickup roller needs to be held in contact with the upper surface of the uppermost document. However, if the pickup roller is present at a position where the pickup roller can be held in contact with the upper surface of the uppermost document, it stands as a hindrance when a user sets new documents on the document tray. Accordingly, there is known an image reading apparatus configured to retract a pickup roller upward upon the elapse of a predetermined time after a document reading operation is finished so that a user can easily set next documents on the document tray.

In some cases, a motor for generating a drive force for retracting the pickup roller upward is desirably also used to drive another member. Thus, an electromagnetic clutch may be provided to interrupt connection between the motor and a mechanism for retracting the pickup roller upward. However, if the electromagnetic clutch is disengaged in a state where the pickup roller is retracted upward by the drive force of the motor as described above, the pickup roller hangs down under its own weight and stands as a hindrance when a user sets document. On the other hand, there has been an inconvenience that power consumption increases if the electromagnetic clutch is kept engaged.

SUMMARY

A sheet feeder according to one aspect of the present disclosure includes a sheet placing portion, a feeding member, a supporting body, a driver, an electromagnetic clutch and a retraction controller. A sheet is to be placed on the sheet placing portion. The feeding member picks up a sheet from the sheet placing portion. The supporting body supports the feeding member and is capable of changing a posture between a sheet feeding posture for bringing the feeding member into contact with the upper surface of a sheet placed on the sheet placing portion and a retracting posture for retracting the feeding member upward relative to the sheet feeding posture. The driver outputs a drive force for changing the posture of the supporting body to the retracting posture against a gravitational force. The electromagnetic clutch is capable of changing a state between an engaged state in which a drive force output from the driver is transmitted to the supporting body and a disengaged state in which the drive force is not transmitted to the supporting body. The retraction controller performs a retraction holding process for switching the supporting body to the retracting posture. The retraction holding process is a process for stopping the output of a drive force by the driver after the electromagnetic clutch is set in the engaged state and the supporting body is set to the retracting posture by the drive force from the driver and setting the electromagnetic clutch in the disengaged state when an engagement keeping time set in advance elapses after the output of the drive force is stopped.

Further, an image processing apparatus according to another aspect of the present disclosure includes the above sheet feeder and a processor. The processor performs a predetermined process using a sheet picked up by the feeding member.

These and other objects, features and advantages of the present disclosure will become more apparent upon reading the following detailed description along with the accompanying drawings.

DETAILED DESCRIPTION

Figure 1:
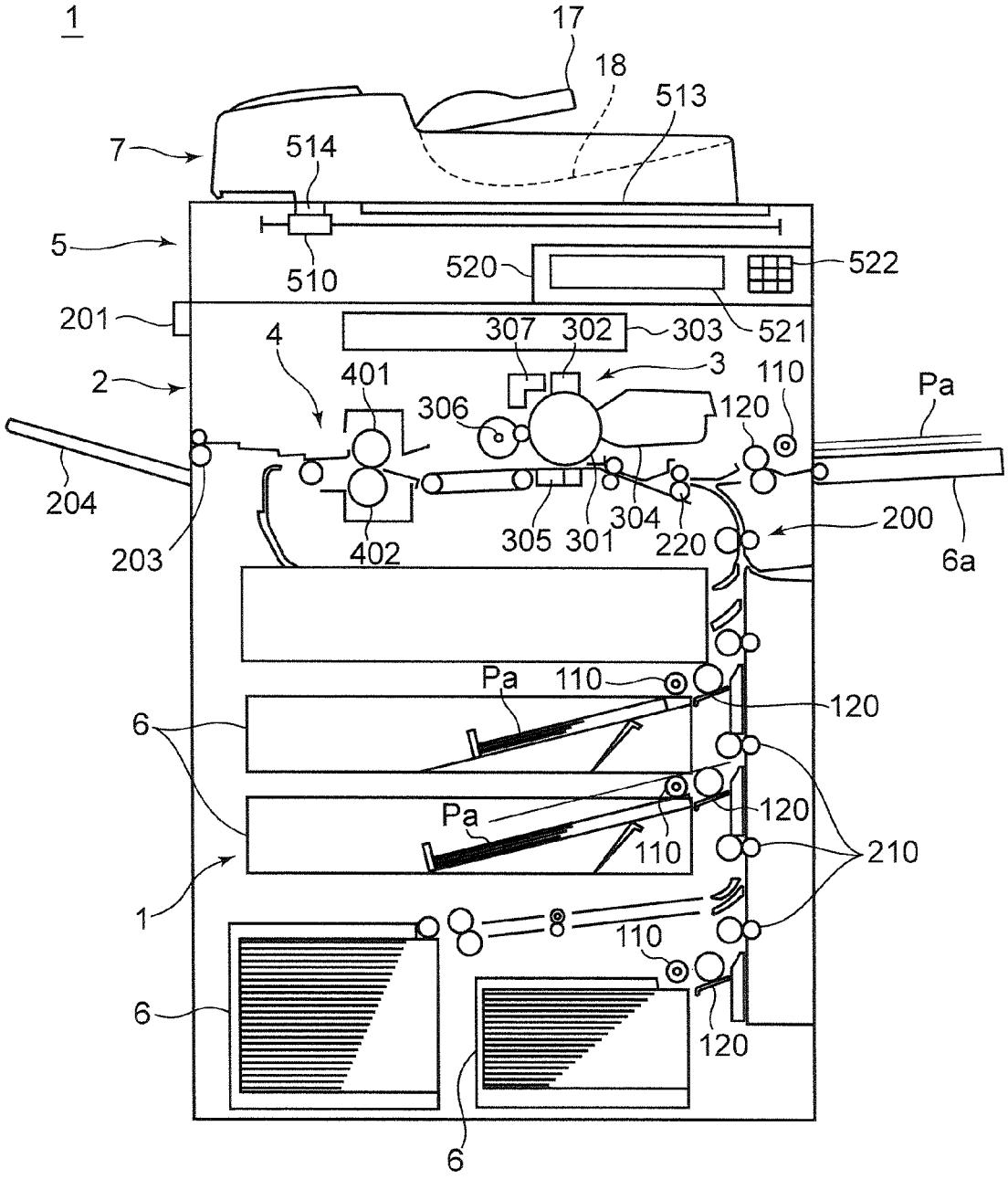
FIG. 1 is a structural diagram schematically showing the internal configuration of a copier as an example of an image processing apparatus according to one embodiment of the present disclosure.

Hereinafter, embodiments according to the present disclosure are described based on the drawings. Note that components denoted by the same reference signs in the respective drawings have the same configurations and not repeatedly described. FIG. 1 is a structural diagram schematically showing the internal configuration of a copier as an example of an image processing apparatus according to one embodiment of the present disclosure. The copier 1 shown in FIG. 1 includes an auto document feeder 7 as an example of a sheet feeder according to one embodiment of the present disclosure. Note that the image processing apparatus is not limited to the copier and may be a scanner apparatus, a printer, a facsimile machine or a complex machine provided with these functions.

The copier 1 includes a main body 2, a document tray 204 arranged on the left side of the main body 2, a document reading unit 5 arranged atop the main body 2 and the auto document feeder (ADF) 7 openably and closably arranged atop the document reading unit 5.

A substantially rectangular operation panel unit 520 is provided on a front part of the copier 1. The operation panel unit 520 includes a display unit 521 and an operation key unit 522. The display unit 521 is composed of a liquid crystal display or the like having a touch panel function. The operation key unit 522 includes various keys and switches such as a start key used by a user to enter a print execution instruction and a numerical keypad used to enter a number of print copies and the like.

The document reading unit 5 includes a scanner unit 510 (see FIG. 2) composed of a CCD (Charge Coupled Device) 512, an exposure lamp 511 and the like, a document platen 513 formed of a transparent material such as glass and a document reading slit 514. The scanner unit 510 is configured to be movable by an unillustrated driver and is moved along a document surface at a position facing the document platen 513 and outputs obtained image data while scanning a document image to a main control unit 100 to be described later when reading a document placed on the document platen 513.

Further, the scanner unit 510 is moved to a position facing the document reading slit 514, obtains a document image in synchronization with a document conveying operation by the auto document feeder 7 via the document reading slit 514 and outputs the obtained image data to the main control unit 100 to be described later when reading a document fed by the auto document feeder 7. The document reading slit 514 is arranged at a position corresponding to an image reading position 80 to be described later. The scanner unit 510 (processor) performs a process of reading an image of a document conveyed to the image reading position 80 by the auto document feeder 7 via the document reading slit 514.

The auto document feeder 7 includes a document feed tray (sheet placing portion) on which documents are to be placed, and a document discharge tray 18 to which documents having images already read are to be discharged. The auto document feeder 7 is described in detail later.

The main body 2 includes a plurality of sheet cassettes 6 (sheet placing portion), a manual feed tray 6*a* (sheet placing portion), pickup rollers 110 (feeding member) for picking up sheets Pa (sheet) one by one from the sheet cassette 6 or the manual feed tray 6*a*, feed rollers 120 for feeding the sheet picked up by the pickup roller 110 to a sheet conveyance path 200 (conveyor), the sheet conveyance path 200 for conveying the sheet fed by the pickup roller 120 to an image forming unit 3, the image forming unit 3 (processor) for forming an image on a sheet conveyed along the sheet conveyance path 200 and the main control unit 100 to be described later.

The pickup rollers 110 and the feed rollers 120 are supported by an unillustrated supporting member and form a sheet feeding member. The pickup rollers 110, the feed rollers 120 and the supporting member are driven by unillustrated motors, electromagnetic clutches for transmitting drive forces of the motors and other transmitting mechanisms. The configuration and operation of the sheet feeding member are not described since they are similar to those of a sheet feeding member 30 in the auto document feeder 7 to be described later.

The sheet Pa fed by the feed roller 120 is conveyed toward the image forming unit 3 along the sheet conveyance path 200 by conveyor roller pairs 210 and a registration roller pair 220. Further, along the sheet conveyance path 200, the sheet Pa having an image formed thereon is conveyed to a fixing unit 4 and the sheet Pa having the image fixed thereto in the fixing unit 4 is discharged onto a discharge tray 204 by a discharge roller pair 203.

The image forming unit 3 forms a predetermined toner image on a sheet Pa. The image forming unit 3 includes a photoconductive drum 301 with photoconductivity rotatably supported on a shaft. Further, the image forming unit 3 includes a charging unit 302, an exposure unit 303, a developing unit 304, a transfer unit 305, a cleaner 306 and a charge removing unit 307 arranged around the photoconductive drum 301.

The charging unit 302 charges a surface of the photoconductive drum 301 by applying a predetermined potential. The exposure unit 303 selectively attenuates the potential on the surface of the photoconductive drum 301 to form an electrostatic latent image on the surface of this photoconductive drum 301 by irradiating a laser beam to the photoconductive drum 301 based on image data of a document read by the document reading unit 5.

The developing unit 304 forms a toner image on the surface of the photoconductive drum 301 by developing the electrostatic latent image with a toner. The transfer unit 305 transfers the toner image on the surface of the photoconductive drum 301 to the sheet Pa. The cleaner 306 removes the toner remaining on the surface of the photoconductive drum 301 after the image transfer. The charge removing unit 307 removes electric charges remaining on the surface of the photoconductive drum 301.

The fixing unit 4 is arranged downstream of the image forming unit 3 in a sheet conveying direction. The fixing unit 4 heats a sheet Pa having a toner image transferred thereto in the image forming unit 3 by sandwiching the sheet Pa between a heating roller 401 and a pressure roller 402, thereby fixing the toner image onto the sheet Pa.

Figure 2:
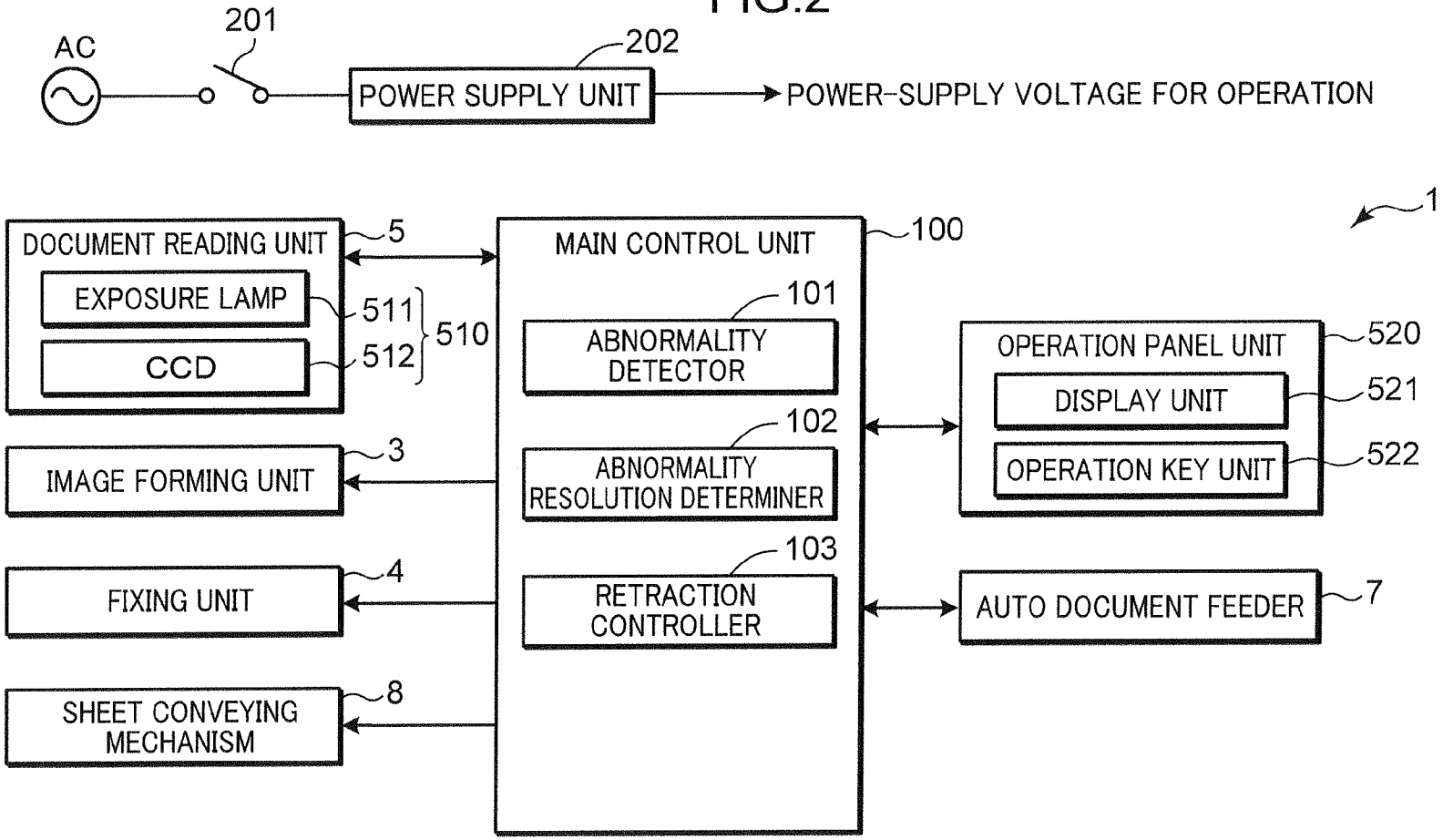
FIG. 2 is a block diagram showing an example of the electrical configuration of the copier shown in FIG. 1.

FIG. 2 is a block diagram showing an example of the electric configuration of the copier 1 shown in FIG. 1. The main control unit 100 is a control circuit which governs the operation of the entire copier 1. The main control unit 100 includes a CPU (Central Processing Unit) for performing, for example, predetermined arithmetic processings, a ROM (Read Only Memory) storing a predetermined control program, a RAM (Random Access Memory) for temporarily storing data, peripheral circuits of these and the like.

The document reading unit 5, the image forming unit 3, the fixing unit 4, the operation panel unit 520, the auto document feeder 7 and a sheet conveying mechanism 8 are connected to the main control unit 100. The sheet conveying mechanism 8 is a generic term for all the mechanisms for conveying the sheet Pa such as the pickup rollers 110, the feed rollers 120 and the sheet conveyance path 200. The main control unit 100 governs the operation of the entire copier 1 by controlling the operation of each component of the copier 1 by executing the predetermined control program.

Further, the main control unit 100 constitutes an abnormality detector 101, an abnormality resolution determiner 102 and a retraction controller 103 by executing the predetermined control program.

Further, the copier 1 includes a power switch 201 and a power supply unit 202. The power switch 201 is an operation switch operable by a user. The power switch 201 is arranged between a commercial power supply AC and the power supply unit 202. When the power switch 201 is turned on, power is supplied from the commercial power supply AC to the power supply unit 202.

The power supply unit 202 is configured using, for example, a switching power supply circuit. When the power switch 201 is turned on, the power supply unit 202 generates a power-supply voltage for operation used to operate each component in the copier 1 based on the power supplied from the commercial power supply AC and supplies the generated power-supply voltage to each component. In this way, the copier 1 is started when the user turns on the power switch 201.

The abnormality detector 101 monitors a state of a sheet Pa in the sheet conveyance path 200 using unillustrated sheet sensors arranged at specified positions of the sheet conveyance path 200 and detects a sheet jam when an abnormality occurs in the conveyance of the sheet Pa, for example, such as when the sheet Pa does not reach the image forming unit 3 even after the elapse of a monitoring time set in advance after the feed by the feed roller 120. An unillustrated open/close door is arranged on the front surface of the main body 2. Further, the main body 2 includes an unillustrated open/close sensor for detecting an open/closed state of the open/close door.

When detecting a sheet jam, the abnormality detector 101 causes the display unit 521 to display a message prompting the user to remove a sheet jammed in the sheet conveyance path 200 by opening the open/close door.

For example, when the opening of the open/close door is detected by the open/close sensor after a sheet jam is detected by the abnormality detector 101 and, then, the closing of the open/close door is detected by the open/close sensor, the abnormality resolution determiner 102 judges that the sheet jam has been resolved since a sheet Pais thought to have been removed by the user. Note that the abnormality resolution determiner 102 judges that an abnormality has been resolved and outputs a signal indicating the resolution of the abnormality to the retraction controller 103 when a certain abnormality, not limited to the sheet jam, is resolved.

When the resolution of an abnormality, e.g. a sheet jam is judged by the abnormality resolution determiner 102, the retraction controller 103 performs a retraction holding process similar to the one performed by a retraction controller 705 to be described later on the motor (driver) and the electromagnetic clutch corresponding to the pickup roller 110 and the feed roller 120. Further, for example, when the power switch 201 is turned on and the copier 1 is started, the retraction controller 103 may perform the retraction holding process to be described later to the motors and the electromagnetic clutches corresponding to the pickup rollers 110 and the feed rollers 120.

In this case, an example of the sheet feeder is configured by the sheet cassettes 6, the manual feed tray 6*a*, the pickup rollers 110 and the feed rollers 120 respectively corresponding to these, the sheet feeding member such as a supporting body for supporting these, the motors, the electromagnetic clutches, the main control unit 100 and the like. These pickup rollers 110, feed rollers 120, supporting body, sheet feeding member, motors and electromagnetic clutches are configured similar to a pickup roller 33, a feed roller 32, a supporting body 31, the sheet feeding member 30, a drive motor 70 and an electromagnetic clutch 530.

Figure 3:
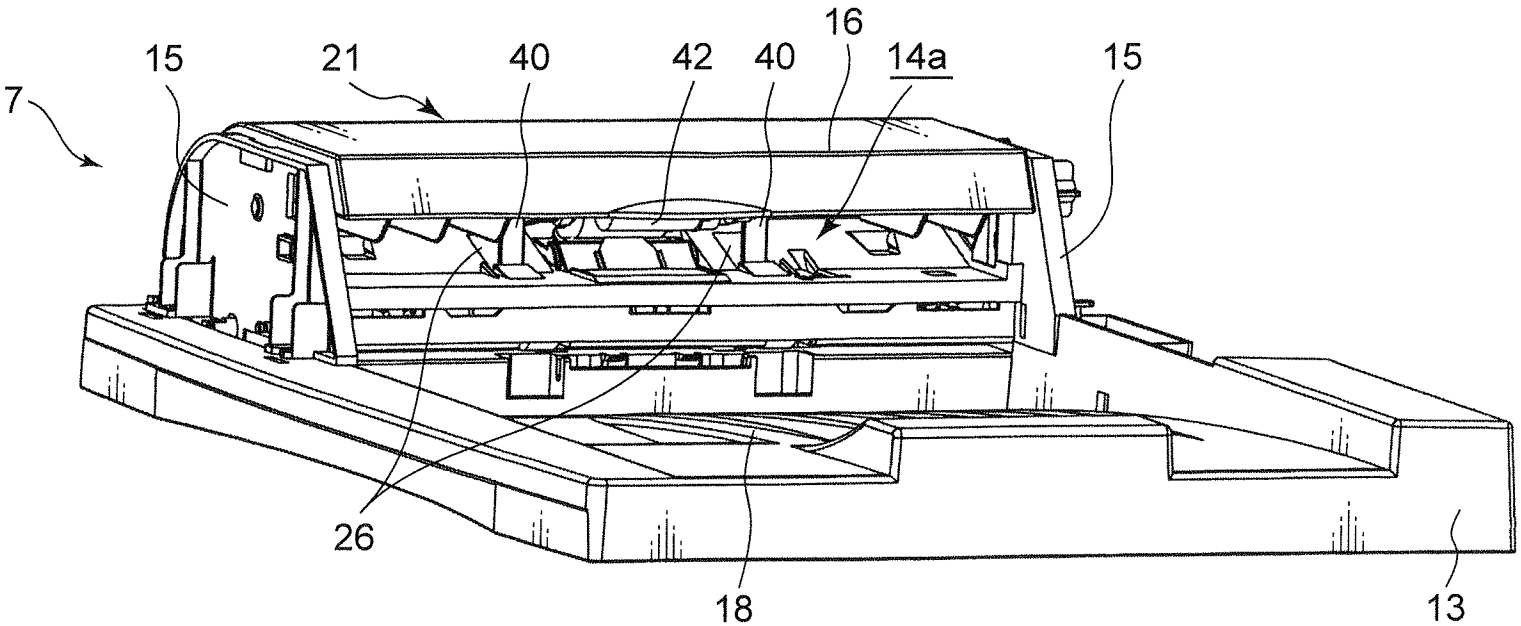
FIG. 3 is a perspective view showing the interior of an auto document feeder as an example of a sheet feeder according to one embodiment of the present disclosure when viewed from a document supply opening side.

FIG. 3 is a perspective view showing the interior of the auto document feeder 7 as an example of the sheet feeder according to one embodiment of the present disclosure when viewed from a document supply opening side. FIG. 3 shows a state where the document feed tray 17 is removed from the auto document feeder 7 shown in FIG. 1.

The auto document feeder 7 includes a base 13 arranged to close an opening in the upper surface of the document reading unit 5, and a feeder main body 21 provided on one end side (left side of the copier 1 in FIG. 1) of the base 13. The feeder main body 21 projects upward from one end part of the base 13 and includes a pair of side plates 15 facing each other in a width direction (direction perpendicular to a document conveying direction) and a cover body 16 mounted between upper parts of these side plates 15.

A document feed opening 14*a* enclosed by the end edges of the respective side plates 15 and the end edge of the cover body 16 is formed between the pair of side plates 15. The document feed tray 17 (sheet placing portion) (see FIG. 4) projects obliquely outward from this document feed opening 14*a* for documents Pb, and the documents Pb placed on this document feed tray 17 are fed to the feeder main body 21 through the document feed opening 14*a*.

A document presence sensor 93 (sheet detector) (see FIG. 4) for detecting whether or not there is any document Pb present on the document feed tray 17 is arranged at a position of the document feed tray 17 near the document feed opening 14*a*.

A pair of stoppers 40 spaced apart in the width direction are provided in a part facing the document feed opening 14*a* in the feeder main body 21 as shown in FIG. 3. These stoppers 40 are described in detail later.

On the other hand, a document discharge opening 14*b* through which the document Pb having an image already read at the document reading slit 514 by the scanner unit 510 is discharged is formed at a position below the document feed tray 17 between the pair of side plates 15. Further, the upper surface of the base 13 facing the document feed tray 17 below the document feed tray 17 is recessed to form the document discharge tray 18. The documents Pb discharged through the document discharge opening 14*b* are stacked on this document discharge tray 18.

Figure 4:
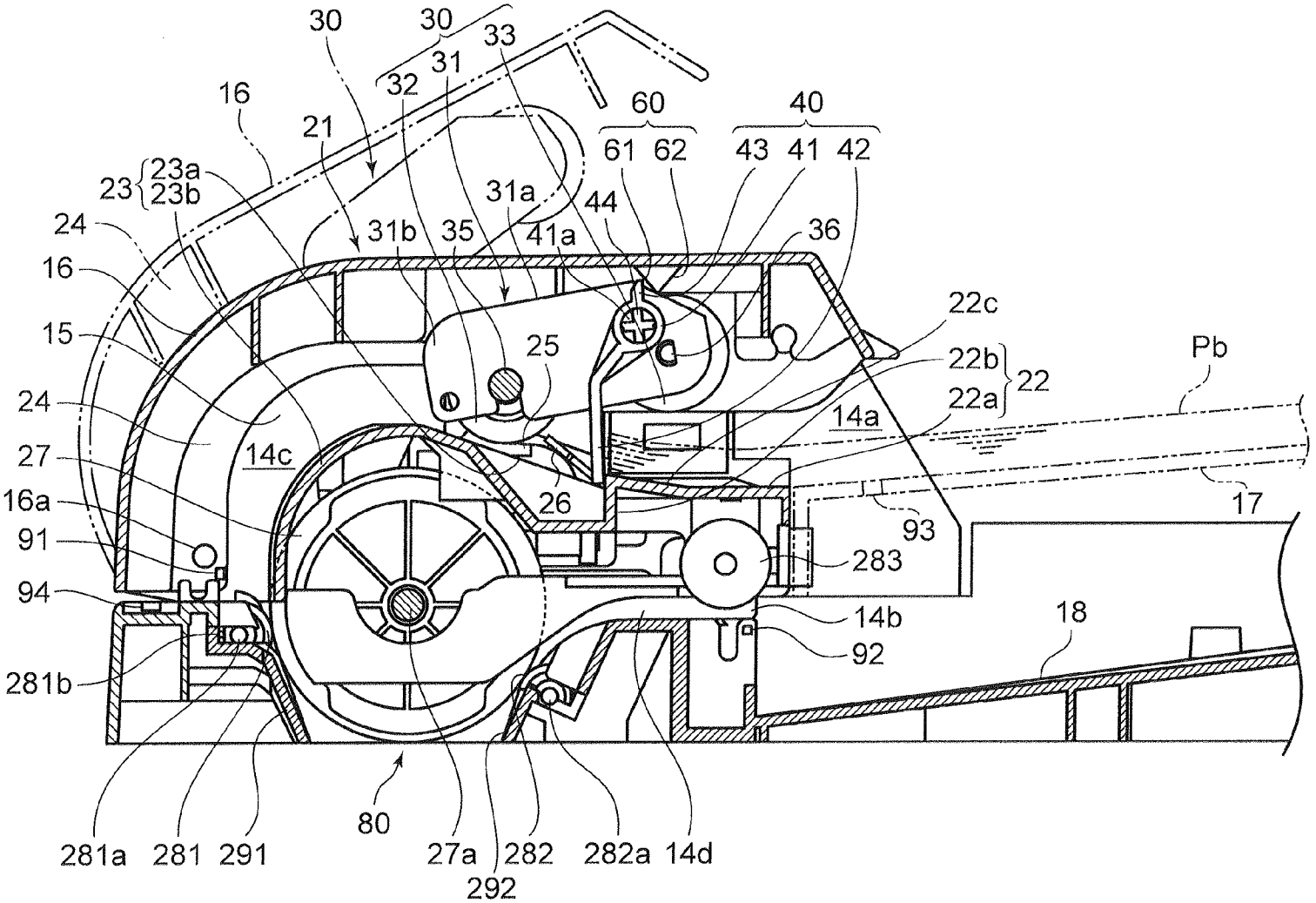
FIG. 4 is a side view in section mainly showing a part of a feeder main body of the auto document feeder shown in FIG. 3.
Figure 5:
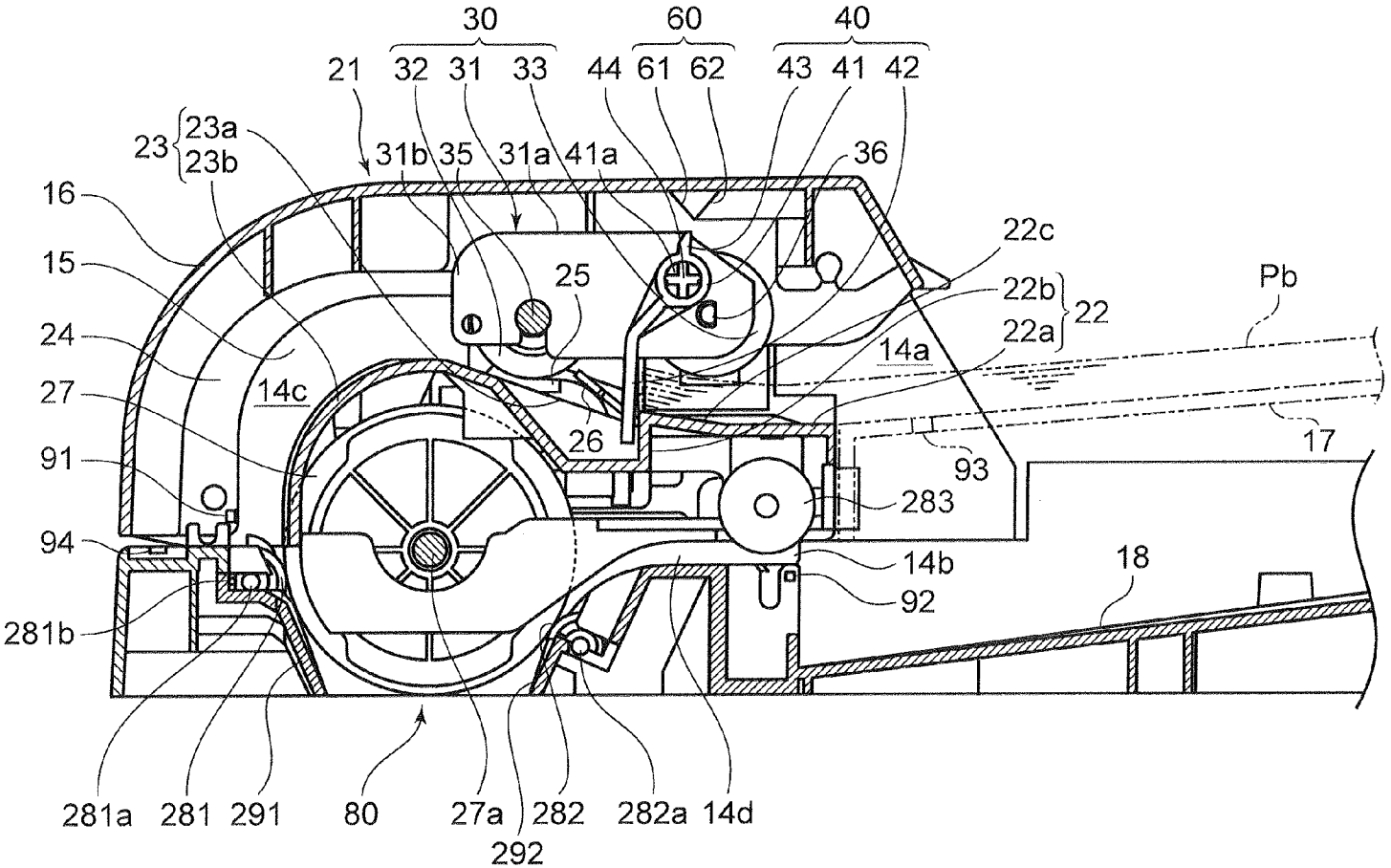
FIG. 5 is a side view in section mainly showing the part of the feeder main body of the auto document feeder shown in FIG. 3.
Figure 6:
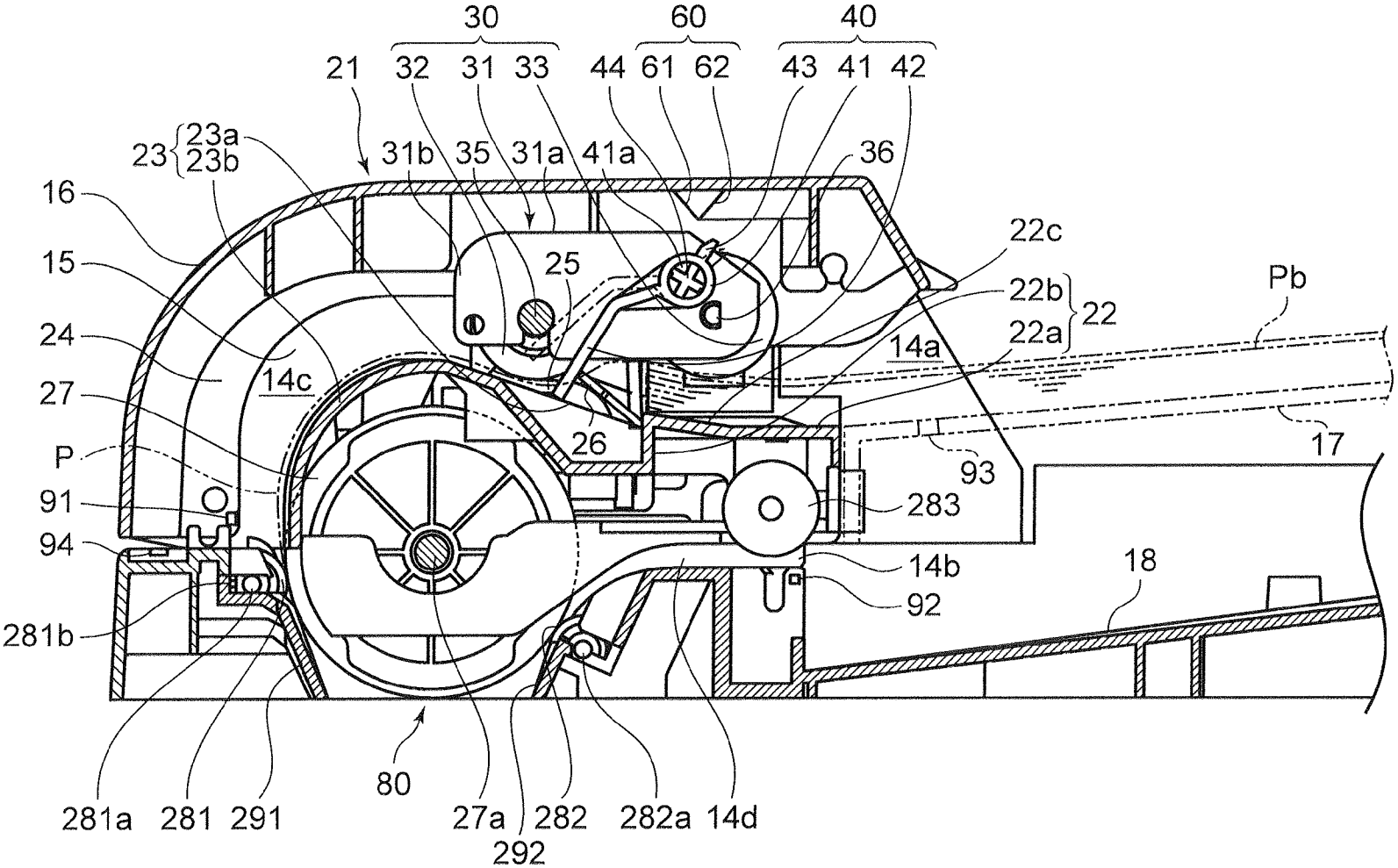
FIG. 6 is a side view in section mainly showing the part of the feeder main body of the auto document feeder shown in FIG. 3.
Figure 7:
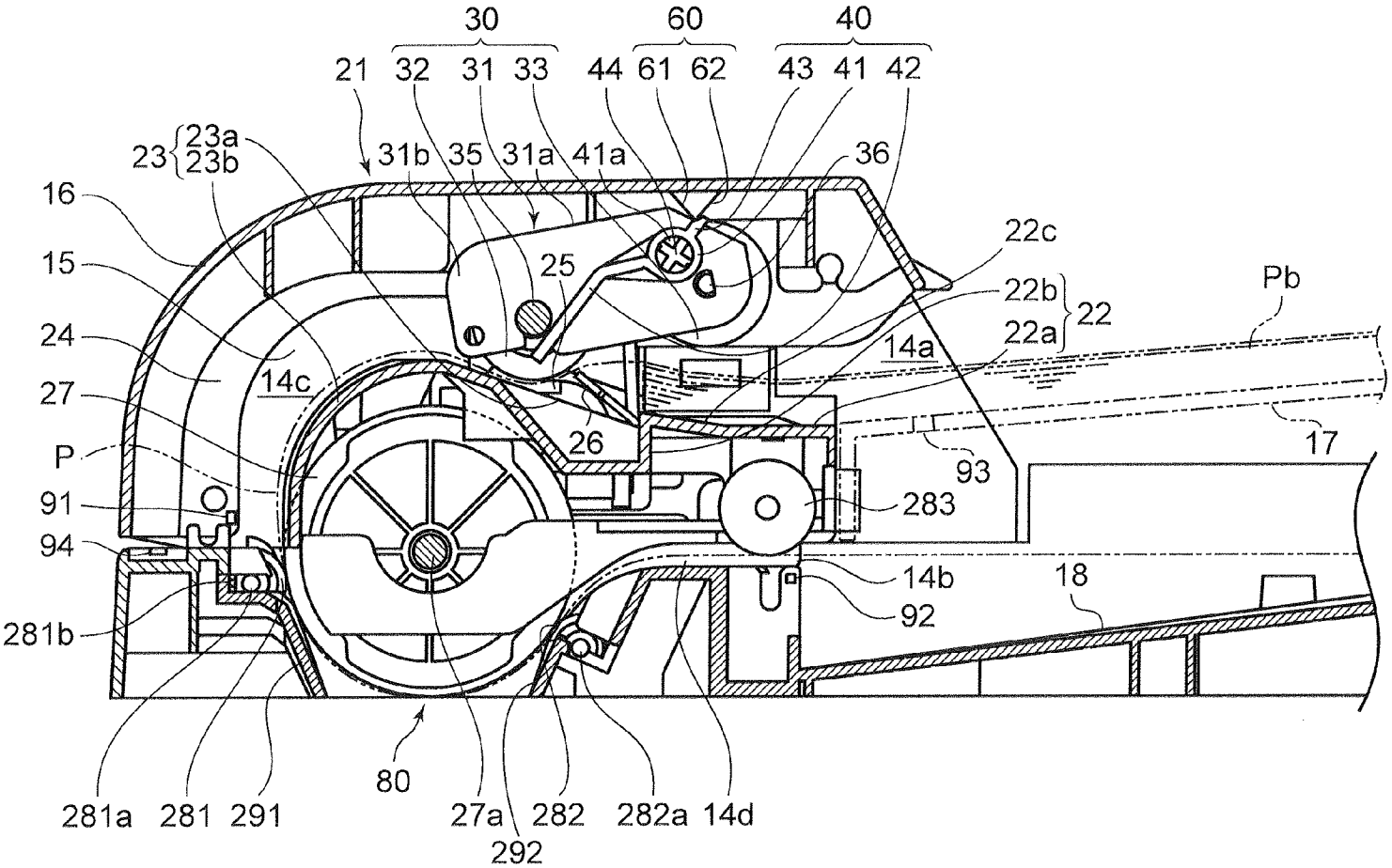
FIG. 7 is a side view in section mainly showing the part of the feeder main body of the auto document feeder shown in FIG. 3.

FIGS. 4 to 7 are side views in section mainly showing a part of the feeder main body 21 of the auto document feeder 7 according to the present disclosure. FIG. 4 shows a state where the supporting body is set at a retracting position and in a retracting posture and the stoppers are set at a sheet contact position, FIG. 5 shows a state where the supporting body is set at a sheet feeding position and in a sheet feeding posture and the stoppers are free to turn at the sheet contact position, FIG. 6 shows a state where the supporting body is set at the sheet feeding position and in the sheet feeding posture and the stoppers are set at a sheet passage allowing position, and FIG. 7 shows a state where the supporting body is set at the retracting position and in the retracting posture and the stoppers are set at a sheet avoiding position.

As shown in FIGS. 4 to 7, the feeder main body 21 has a basic configuration including the sheet feeding member 30 for picking up the uppermost document Pb of a stack of documents Pb placed on the document feed tray 17 one by one and feeding it into the feeder main body 21, the stoppers 40 attached to this sheet feeding member 30, and a gear mechanism 50 (see FIG. 10) for feeding the document Pb picked up by the sheet feeding member 30 to the image reading position 80 facing the document reading slit 514 after the position of the document Pb is adjusted. The leading end edge of the stack of documents Pb placed on the document feed tray 17 by a user is brought into contact with the stoppers 40.

Figure 8:
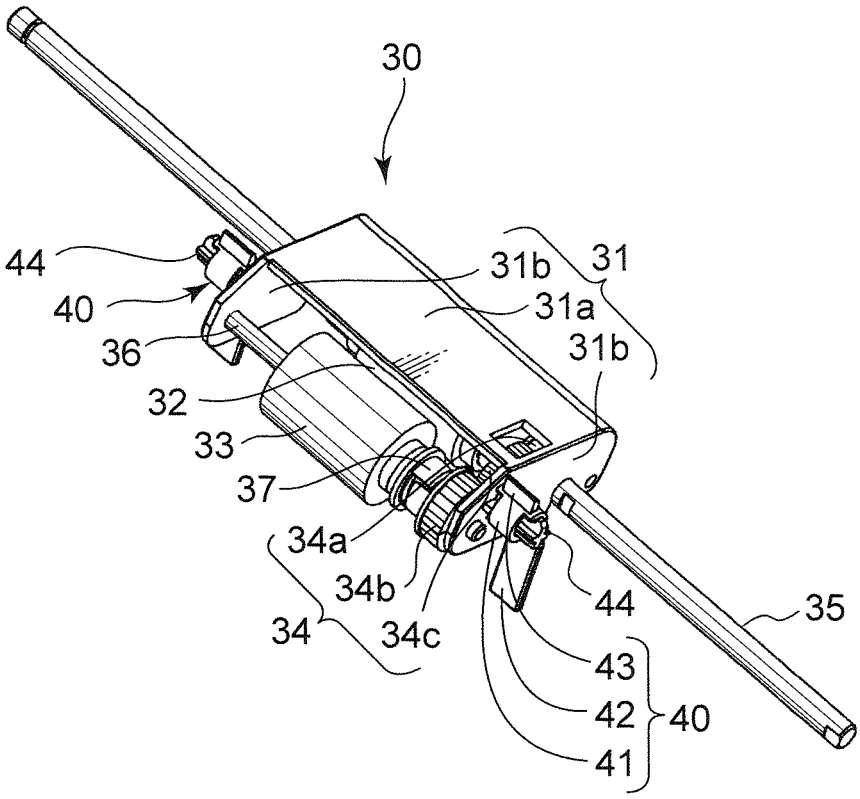
FIG. 8 is a perspective view showing one embodiment of a sheet feeding member shown in FIGS. 4 to 7.
Figure 9:
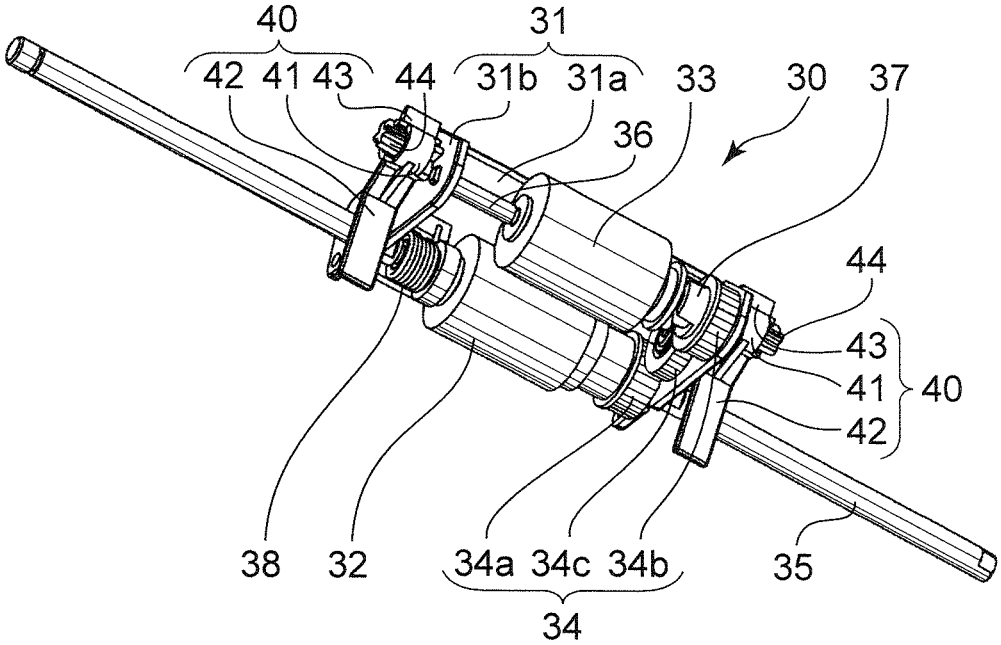
FIG. 9 is a perspective view showing the one embodiment of the sheet feeding member shown in FIGS. 4 to 7.

FIGS. 8 and 9 are perspective views showing one embodiment of the sheet feeding member 30. FIG. 8 shows a state when the sheet feeding member 30 is viewed obliquely from above and FIG. 9 shows a state when the sheet feeding member 30 is viewed obliquely from below. The sheet feeding member 30 is described below based on FIGS. 8 and 9 while referring to FIGS. 4 to 7 if necessary.

As shown in FIGS. 8 and 9, the sheet feeding member 30 includes the supporting body 31, the feed roller 32 and the pickup roller 33 (feeding member) supported on this supporting body 31 and gears 34 for allowing the feed roller 32 and the pickup roller 33 to rotate together. The supporting body 31 is formed, for example, of a molded article made of synthetic resin and includes a ceiling plate 31*a* and a pair of side plates 31*b* respectively hanging down from opposite end parts of this ceiling plate 31*a* and spaced apart in the width direction.

The feed roller 32 is supported rotatably about a long shaft (rotary shaft) penetrating through base end sides (left sides, downstream sides in the document conveying direction in FIG. 4) between the respective side plates 31*b* of the supporting body 31. The long shaft 35 is mounted between central upper positions of the pair of side plates 15 of the feeder main body 21, whereby the sheet feeding member 30 is mounted into the feeder main body 21.

The pickup roller 33 is supported rotatably about a short shaft 36 supported between leading end sides (right sides, upstream sides in the document conveying direction in FIG. 4) of the respective side plates 31*b* of the supporting body 31. The short shaft 36 is arranged in parallel to the long shaft 35. The sheet feeding member 30 is set to the sheet feeding posture where the pickup roller 33 presses the leading end parts of the documents Pb by the supporting body 31 being rotated clockwise in FIG. 4 about the long shaft 35. Further, the sheet feeding member 30 is set to the retracting posture where the documents Pb are released from the pressing by the pickup roller 33 by the supporting body 31 being rotated counterclockwise about the long shaft 35. The supporting body 31 can change the posture between the sheet feeding posture and the retracting posture in this way. In the sheet feeding posture, the pickup roller 33 is set at a sheet feeding position. In the retracting posture, the pickup roller 33 is set at a retracted position.

The gears 34 include a feed roller gear 34*a* mounted with the long shaft 35 so as to integrally rotate with the feed roller 32, a pickup roller gear 34*b* mounted in sliding contact with the short shaft 36 via the pickup roller 33 and a one-way clutch 37, and an intermediate gear 34*c* (rotational drive transmitter) interposed between these gears 34*a* and 34*b* and engaged with both.

The one-way clutch 37 is set to transmit the clockwise rotation of the pickup roller gear 34*b* about the short shaft 36 in FIGS. 4 and 9 to the pickup roller 33 and, on the other hand, not to transmit the counterclockwise rotation thereof. This prevents the occurrence of such an inconvenience that the pickup roller 33 rotates counterclockwise about the short shaft 36 to feed the document on the document feed tray 17 in an opposite direction.

Figure 10:
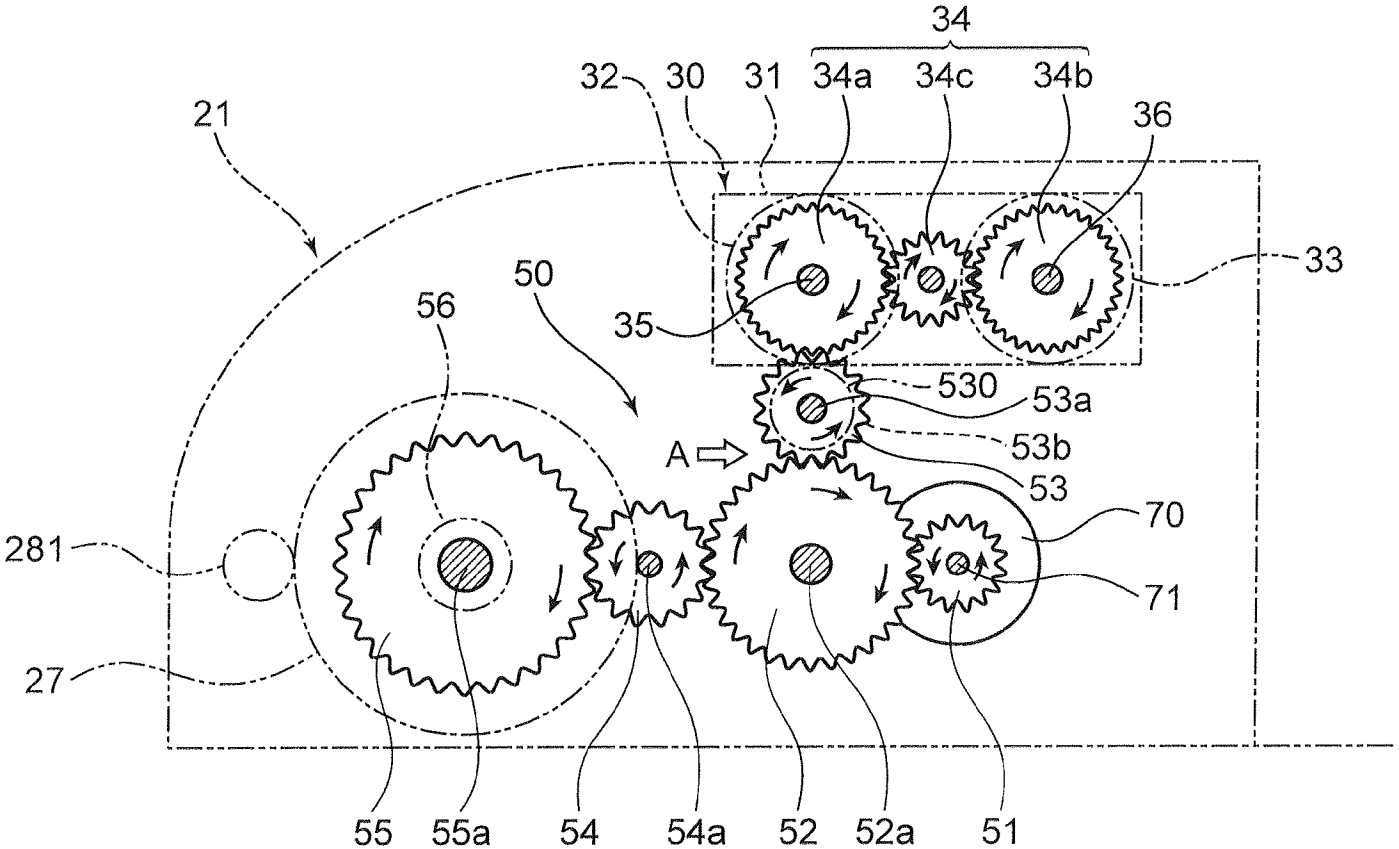
FIG. 10 is a diagrammatic side view for explaining one embodiment of a gear mechanism of the feeder main body.

The feed roller gear 34*a* is rotated by receiving a drive force from the drive motor 70 (driver) shown in FIG. 10 via the gear mechanism 50, and the forward and reverse rotations thereof are synchronously transmitted to the pickup roller gear 34*b* via the intermediate gear 34*c*. Further, the feed roller gear 34*a* and the pickup roller gear 34*b* are set to have the same diameter, whereby the both rotate at the same number of revolutions.

A coil spring 38 (drive force transmitter) loosely mounted on the long shaft 35 is interposed in a compressed state between an end surface of the feed roller 32 opposite to the feed roller gear 34*a* and the sideplate 31*b* of the supporting body 31 facing this end surface. Accordingly, the rotation of the feed roller 32 is transmitted to the supporting body 31 by a frictional force generated between the coil spring 38 and the end surface of the feed roller 32 and between the coil spring 38 and the side plate 31*b*. In this case, the feed roller 32 and the coil spring 38 correspond to an example of the drive force transmitter.

Note that the rotation of the long shaft 35 may be directly transmitted to the supporting body 31 (side plate 31) by the coil spring 38. Further, the counterclockwise rotation of the long shaft 35 may be transmitted to the supporting body 31, for example, by a one-way clutch which is an example of the drive force transmitter, instead of the coil spring 38.

Accordingly, in a state where no external force is acting on the supporting body 31, the supporting body 31 integrally rotates with the feed roller 32 about the long shaft 35, whereas the pickup roller 33 is brought into contact with the documents Pb on the document feed tray 17 by the clockwise rotation of the supporting body 31, and the pickup roller 33 is stopped. In this way, in the state where the supporting body 31 is set in the sheet feeding posture (see FIG. 6), a rotational force larger than the frictional force is applied to the feed roller 32, and the supporting body 31 is stopped, whereby a turning movement of the supporting body 31 is prevented while the rotation of the feed roller 32 is continued.

Contrary to this, when the supporting body is set in the retracting posture by coming into contact with the ceiling of the cover body 16 due to its counterclockwise turning movement about the long shaft 35 (see FIG. 4), the turning movement of the supporting body 31 is prevented while the counterclockwise rotation of the feed roller 32 is continued.

Hereinafter, the rotation of the drive motor 70 in a direction to rotate the feed roller 32 clockwise and set the supporting body 31 to the sheet feeding posture is called forward rotation and the rotation of the motor 70 to rotate the feed roller 32 counterclockwise and set the supporting body 31 to the retracting posture is called reverse rotation.

On the other hand, a document leading end receiving portion 22 connected to a downstream end of the document feed tray 17 and having an upper surface continuous with the upper surface of the document feed tray 17 is formed in the feeder main body 21. This document leading end receiving portion 22 is provided at a position slightly below the feed roller 32 and right below the pickup roller 33. Such a document leading end receiving portion 22 is composed of a document placing plate 22*a* (sheet placing portion) on which leading end parts of the documents Pb are placed and a vertical plate 22*b* hanging down from a downstream end (left end in FIG. 4) of this document placing plate 22*a*. The document placing plate 22*a* includes an inclined portion 22*c* inclined upward toward a downstream side (left side in FIG. 4) when viewed sideways as shown in FIG. 4. Due to the presence of this inclined portion 22*c*, the leading end parts of the documents Pb placed on the document placing plate 22*a* are inclined upward. This makes the documents Pb easily pulled toward the feed roller 32 by the rotation of the pickup roller 33.

Further, an inner guiding element 23 for guiding the document Pb toward a downstream side (left side in FIG. 4) is provided at a position of the vertical plate 22*b* slightly above a vertical middle position. Further, an outer guiding element 24 extending from a downstream end position of the supporting body 31 is provided at a position more outward than the inner guiding element 23 in the feeder main body 21 in correspondence with the inner guiding element 23.

The inner guiding element 23 is composed of an inclined guiding portion 23*a* connected to the vertical plate 22*b* of the document leading end receiving portion 22 and inclined upward toward the downstream side and an arcuate guiding portion 23*b* extending from this inclined guiding portion 23*a* in an arcuate manner (specifically, in the shape of a quarter arc) such that the leading end faces downward. On the other hand, the outer guiding element 24 is so shaped that a clearance between itself and the arcuate guiding portion 23*b* is substantially constant. An arcuate guiding space 14*c* for guiding the document Pb to a registration roller 27 (conveyor) is formed between such an outer guiding element 24 and the arcuate guiding portion 23*b*.

Further, a sliding-contact element 25 arranged so as to be held in sliding contact with a lower part of the circumferential surface of the feed roller 32 or form a small clearance (clearance narrower than the thickness of the document) is provided above the inclined guiding portion 23*a* of the inner guiding element 23. The document Pb introduced into the feeder main body 21 through the document feed opening 14*a* is guided and introduced into the arcuate guiding space 14*c* by the clockwise rotation of the feed roller 32 about the long shaft 35 while being sandwiched between the feed roller 32 and the sliding-contact element 25.

Such a sliding-contact element 25 is formed of a flexible material, which is easily elastically deformable, such as soft foamable synthetic resin and allows the document Pb supplied to between the feed roller 32 rotating clockwise about the long shaft 35 and the sliding-contact element 25 to pass by its compressive elastic deformation. Further, if two documents Pb are supplied to between the feed roller 32 and the sliding-contact element 25, the circumferential surface of the rotating feed roller 32 acts only on the uppermost document Pb while the lower document Pb is blocked by the sliding-contact element 25, wherefore only the upper document Pb is fed into the arcuate guiding space 14*c*.

Further, guide plates 26 whose lower surfaces are in contact with an upstream side of the sliding-contact element 25 and whose leading ends are facing the circumferential surface of the feed roller 32 above a side of the sliding-contact element 25 facing the document feed opening 14*a* extend from an upper end part of the vertical plate 22*b* of the document leading end receiving portion 22. The upper surfaces of these guide plates 26 are set to extend at such a position as to be flush with the upper surface of a lower end part of the vertical plate 22*b* of the document leading end receiving portion 22.

A pair of such guide plates 26 are provided, for example, at positions right downstream of the pair of stoppers 40 in the feeder main body 21 while being spaced apart in the width direction as shown in FIG. 3.

As shown in FIGS. 3 to 7, 8 and 9, the stoppers 40 are supported rotatably about cross shafts (supporting shaft) 44 respectively projecting outward from the respective side plates 31*b* of the supporting body 31 and having a cross end view. The cross shafts 44 are adopted to reduce a contact area between the cross shafts 44 and the inner circumferential surfaces of mounting holes 41*a* of the stoppers 40 fitted on the cross shafts 44, thereby reducing a frictional force when the stoppers 40 rotate and making the stoppers 40 easily rotatable. Such cross shafts 44 are provided at positions between the long shaft 35 and the short shaft 36 on the outer surfaces of the side plates 31*b* of the supporting body 31, closer to the short shaft 36 and slightly above the short shaft 36.

Such a stopper 40 includes a mounting tube 41 with the mounting hole 41*a* fitted in sliding contact with the cross shaft 44, a stopper piece 42 opposed to the leading end edges of the documents on the document leading end receiving portion 22 and an engaging piece 43 projecting upward from the mounting hole 41*a*.

The stopper piece 42 extends downward from the mounting tube 41 and the length thereof is so set that the lower end faces the leading end edges of the documents on the document feed tray 17. The stopper piece 42 is held in contact with the leading end edges of the documents above the left surface of the vertical plate 22*b* of the document leading end receiving portion 22 in FIG. 4.

Such a stopper 40 can change its position between a document contact position (sheet contact position) shown in FIGS. 4 and 5 and a document passage allowing position (sheet passage allowing position) shown in FIG. 6. The document contact position (sheet contact position) is a position where the stopper piece 42 hangs down and a lower end part thereof is held in contact with the upper part of the vertical plate 22*b* of the document leading end receiving portion 22 to face the leading end edges of the documents Pb on the document feed tray 17. The document passage allowing position (sheet passage allowing position) is a position reached when the stopper piece 42 rotates clockwise about the cross shaft 44.

Contrary to this, projections 60 facing the engaging pieces 43 and projecting downward are provided on the underside of the cover body 16. This projection 60 is set to have an inverted triangular side view and includes a first inclined surface 61 inclined in a conveying direction (leftward direction of FIG. 4) of the document Pb and a second inclined surface 62 inclined in a direction opposite to the document conveying direction in this embodiment.

In a state where the sheet feeding member 30 is rotated counterclockwise about the long shaft 35 and set to the retracting posture (FIG. 4), the engaging pieces 43 are in contact with the first inclined surfaces 61. On the other hand, in a state where the sheet feeding member 30 set in the retracting posture is rotated clockwise about the long shaft 35 and set to the sheet feeding posture (FIGS. 5 and 6), the engaging pieces 43 are brought out of contact with the first inclined surfaces 61, whereby the stoppers 40 can change their positions between the document passage allowing position (shown by chain double-dashed line in FIG. 6) and the document contact position (FIG. 5).

Accordingly, in a state where the sheet feeding member 30 is set in the retracting posture and the stoppers 40 are set at the document contact position (FIG. 4), the engaging pieces 43 are held in contact with the first inclined surfaces 61 of the projections 60, whereby the clockwise rotation of the stopper pieces 42 about the cross shafts 44 is prevented. Thus, even if a stack of documents Pb is inserted into the feeder main body 21 through the document feed opening 14*a* and the leading end edge thereof is pressed against the stopper pieces 42, these stopper pieces 42 are not moved, wherefore the leading end edge of the stack of documents Pb can be reliably aligned by pressing the stack of documents Pb against the pair of stopper pieces 42.

Further, if the pickup roller 33 is driven and rotated clockwise about the short shaft 36 in the state where the sheet feeding member 30 is set in the sheet feeding posture, i.e. in the state where the engaging pieces 43 are disengaged from the projections 60 and the pickup roller 33 is pressed in contact with the uppermost document Pb of the document stack, the uppermost document Pb is guided and pulled toward the downstream side by the rotation of the pickup roller 33. At this time, as shown by solid line in FIG. 6, the stopper pieces 42 rotate clockwise about the cross shafts 44 by being pushed by the leading end of the document Pb. By the stopper pieces 42 being further pushed, the document Pb slips under the lower end edges of the stopper pieces 42 and is introduced into the arcuate guiding space 14*c* of the feeder main body 21 as shown by chain double-dashed line in FIG. 6.

When the trailing end edge of the uppermost document Pb of the document stack passes the lower end edges of the stopper pieces 42 shown by chain double-dashed line in FIG. 6, the contact of the lower end edges of the stopper pieces 42 with the document Pb shown in chain double-dashed line is released. As a result, the stoppers 40 rotate counterclockwise about the cross shafts 44, thereby returning to the document contact position as shown in FIG. 5.

It is also possible to deal with a case where the posture of the sheet feeding member 30 is changed to the retracting posture in the state where the stoppers 40 are set at the document passage allowing position, i.e. in the state where the lower end edges of the stopper pieces 42 are in contact with the upper surface of the document Pb as shown in FIG. 6. Specifically, the shape and positions of the projections 60 are so set that the engaging pieces 43 of the stoppers 40 face the second inclined surfaces 62 of the projections 60 in the state where the stoppers 40 are set at the document passage allowing position.

Accordingly, if the sheet feeding member 30 rotates counterclockwise about the long shaft 35 in the state where the stoppers 40 are set at the document passage allowing position, i.e. if the posture is changed to the retracting posture, the engaging pieces 43 are held in contact with the second inclined surfaces 62 of the projections 60 as shown in FIG. 7, thereby preventing the counterclockwise rotation of the stoppers 40 about the cross shafts 44. Thus, such an inconvenience that the lower ends of the stopper pieces 42 held at the document contact position press the upper surface of the document Pb to break the document Pb is avoided.

The registration roller 27 (conveyor), a part of the circumferential surface of which slightly projects toward the document discharge opening 14*b* from a downstream end of the arcuate guiding portion 23*b* of the inner guiding element 23, is provided at a downstream end position of a substantially vertical part of the arcuate guiding space 14*c* in the feeder main body 21. A first idle roller 281 whose circumferential surface is held in contact with the circumferential surface of the registration roller 27 is provided right below the arcuate guiding space 14*c*.

The registration roller 27 is provided concentrically and integrally rotatably about a registration roller shaft 27*a* mounted between the pair of side plates 15 to extend in a direction perpendicular to the conveying direction of the document Pb near a center of curvature position of the arcuate guiding portion 23*b*. The first idle roller 281 is supported rotatably about a first idle roller shaft 281*a* parallel to the registration roller shaft 27*a*.

Since the first idle roller 281 is pressed in contact with the circumferential surface of the registration roller 27 by a biasing force of a biasing means 281*b* for biasing the first idle roller shaft 281*a* toward the registration roller 27, the leading end of the document Pb having reached this position is reliably sandwiched between the circumferential surfaces of the both.

Further, a second idle roller 282 supported rotatably about a second idle roller shaft 282*a* is provided at a position obliquely downward to the right of the registration roller 27 in FIG. 4. Accordingly, the document Pb whose leading end is positioned by the registration roller 27 and the first idle roller 281 is guided by the counterclockwise rotation of the registration roller shaft 27*a* and heads for the image reading position 80 right below the registration roller 27 while being guided by a first paper guide 291. The first paper guide 291 is formed to extend downward substantially along the circumferential surface of the registration roller 27 from the position of the first idle roller 281.

Then, the document Pb having passed the image reading position 80 is guided by the rotation of the registration roller 27 in a state sandwiched between the registration roller 27 and the second idle roller 282 while being guided by a second paper guide 292, and is discharged onto the document discharge tray 18 through the document discharge opening 14*b*. The second paper guide 292 is formed to extent substantially along the circumferential surface of the registration roller 27 at a side downstream (right side in FIG. 4) of the image reading position 80.

Note that a discharge roller 283 which is driven and rotated counterclockwise is provided at a position facing the document discharge opening 14*b* and above a discharge path 14*d* in the feeder main body 21. The document Pb is reliably discharged onto the document discharge tray 18 by the drive rotation of this discharge roller 283.

In the closed state of the auto document feeder 7, the lower circumferential surface of the registration roller 27 and the document reading slit 514 are arranged to face each other via such a small clearance as to allow the passage of the document Pb at the image reading position 80. Accordingly, an image on the document Pb passing above the document reading slit 514 while being guided in sliding contact with the document reading slit 514 by the rotation of the registration roller 27 about the registration roller shaft 27*a* is successively read by the scanner unit 510 as the document Pb moves.

The cover body 16, and the outer guiding element 24 and the sheet feeding member 30 attached to the cover body 16 can be turned counterclockwise about a shaft 16*a* as shown by dashed-dotted line in FIG. 4. This enables the user to remove a document jammed in the feeder main body 21 by opening the cover body 16 upward. A cover open/close sensor 94 for detecting an open/closed state of the cover body 16 is arranged below the cover body 16.

Figure 11:
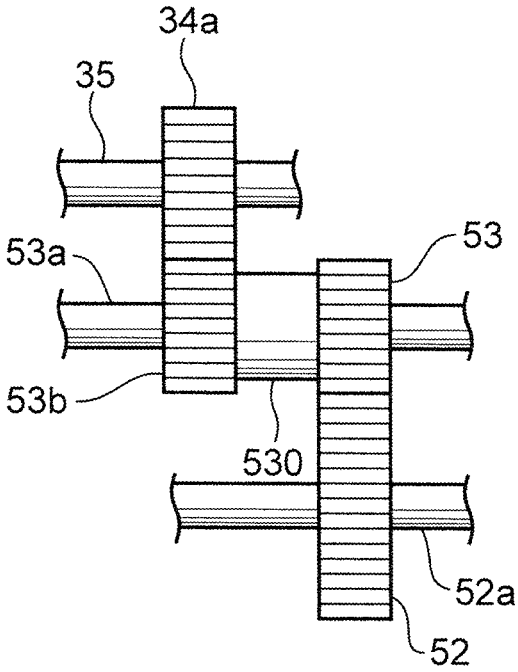
FIG. 11 is a diagrammatic side view for explaining the one embodiment of the gear mechanism of the feeder main body.

FIGS. 10 and 11 are diagrammatic side views for explaining one embodiment of the gear mechanism 50 of the feeder main body 21. FIG. 11 is a view showing a center gear 52, a first intermediate gear 53, a second intermediate gear 53*b* and the feed roller gear 34*a* of FIG. 10 when viewed in a direction of an arrow A of FIG. 10. As shown in FIGS. 10 and 11, the gear mechanism 50 includes a drive gear 51 provided concentrically and integrally rotatably with a drive shaft 71 of the motor 70 provided at a suitable position in the feeder main body 21 and the center gear 52 engaged with this drive gear 51 and supported rotatably about a center gear shaft 52*a*.

The first intermediate gear 53 supported rotatably about a first intermediate gear shaft 53*a* is engaged with the center gear 52. The first intermediate gear 53 is coupled to the second intermediate gear 53*b* concentric with the first intermediate gear 53 and rotatable via the electromagnetic clutch 530. The second intermediate gear 53*b* is engaged with the feed roller gear 34*a*.

Further, a third intermediate gear 54 supported rotatably about a third intermediate gear shaft 54*a* is engaged with the center gear 52. A registration gear 55 supported integrally rotatably about a registration gear shaft 55*a* is engaged with the third intermediate gear 54.

Any of the drive shaft 71, the first intermediate gear shaft 53*a*, the third intermediate gear shaft 54*a* and the registration gear shaft 55*a* extend in a direction perpendicular to the conveying direction of the document Pb. Further, a gear ratio of each gear is so set that a circumferential speed of the pickup roller 33 and that of the registration roller 27 are equal.

A one-way clutch 56 configured to selectively transmit and interrupt a rotational torque of a coil spring or the like in a shaft rotating direction is interposed between the registration gear shaft 55*a* and the registration roller shaft 27*a*. When the registration gear shaft 55*a* rotates in a forward direction (clockwise direction in FIG. 10), the one-way clutch 56 is disengaged and the rotation of the registration gear shaft 55*a* is not transmitted to the registration roller 27. On the other hand, when the registration gear shaft 55*a* rotates in a reverse direction (counterclockwise direction in FIG. 10), the one-way clutch 56 is engaged, whereby the registration roller 27 integrally rotates with the registration gear shaft 55*a*.

The one-way clutch 56 is disengaged until the leading end of a document Pb introduced into the arcuate guiding space 14*c* by the counterclockwise drive rotation of the feed roller 32 about the long shaft 35 reaches a nip position between the registration roller 27 and the first idle roller 281, and the one-way clutch 56 is engaged when the leading end of the document Pb reaches the nip position between the registration roller 27 and the first idle roller 281. In synchronization with this engagement of the one-way clutch 56, the rotation of the drive motor 70 is switched to reverse rotation (clockwise rotation about the drive shaft 71).

A leading end detection sensor 91 (FIGS. 4 to 7) is provided at a lower end position of the outer guiding element 24 facing the registered leading end of the document Pb to detect the leading end of the document Pb. Further, a trailing end detection sensor 92 for detecting the trailing end of the document Pb being discharged to the document discharge tray 18 along the discharge path 14*d* is provided at a position near the document discharge opening 14*b*.

When the leading end detection sensor 91 detects the leading end of the document Pb, a detection signal thereof is input to an ADF control unit 700 described later and the ADF control unit 700 outputs a control signal for switching the rotating direction to the reverse rotating direction to the drive motor 70 based on this detection signal. Further, when the trailing end detection sensor 92 detects the trailing end of the document Pb, a detection signal thereof is input to the ADF control unit 700 described later and the ADF control unit 700 outputs a control signal for clutch disengagement to the one-way clutch 56 based on this detection signal.

Figure 12:
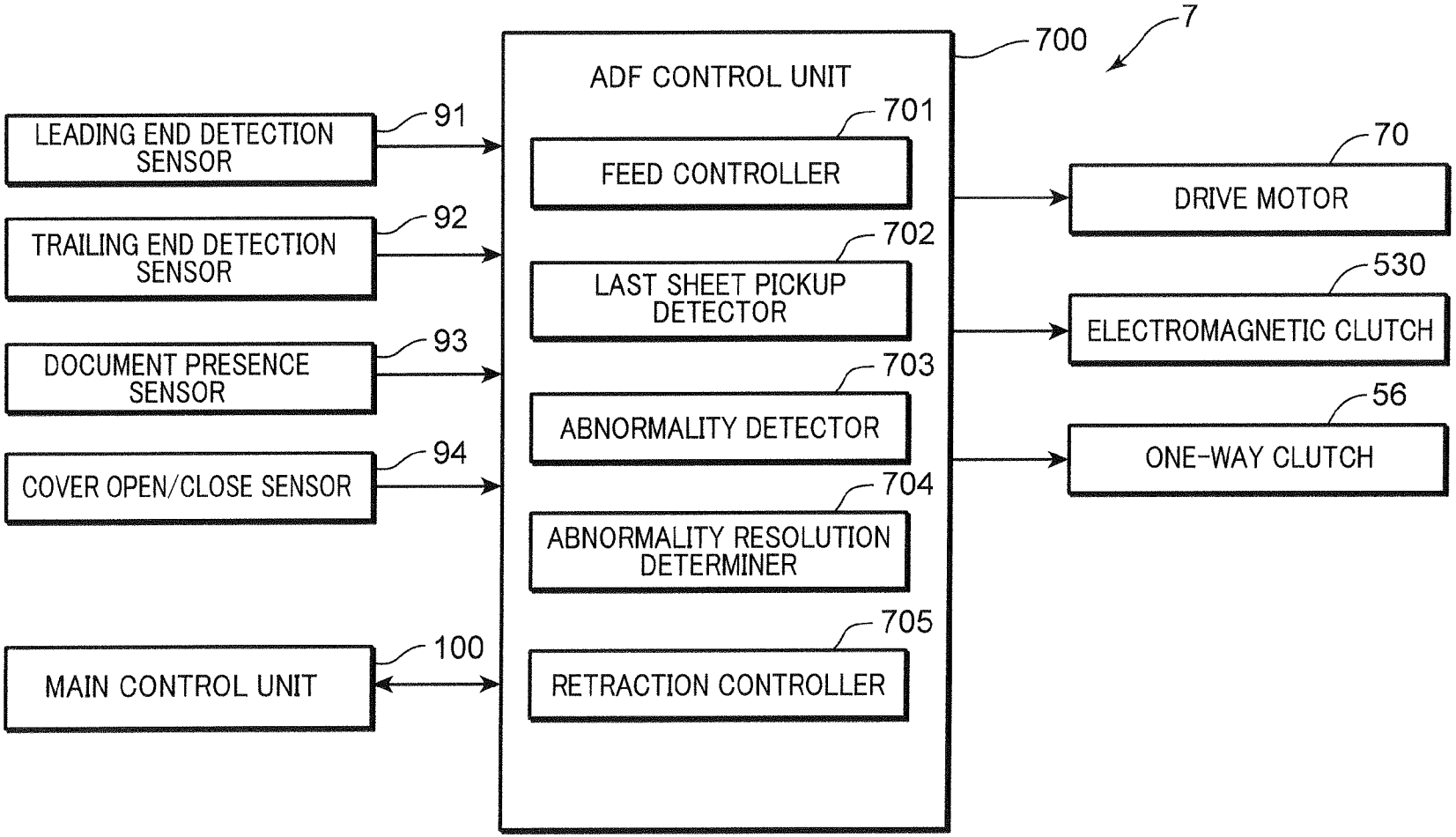
FIG. 12 is a block diagram showing an example of the electrical configuration of the auto document feeder shown in FIG. 3.

FIG. 12 is a block diagram showing an example of the electrical configuration of the auto document feeder 7 shown in FIG. 3. The auto document feeder 7 includes the ADF control unit 700. The main control unit 100, the leading end detection sensor 91, the trailing end detection sensor 92, the document presence sensor 93, the cover open/close sensor 94, a drive motor 70, the electromagnetic clutch 530 and the one-way clutch 56 are connected to the ADF control unit 700. Note that the auto document feeder 7 may include the power switch 201.

The ADF control unit 700 includes a CPU for performing predetermined arithmetic processings, a ROM storing a predetermined control program, a RAM for temporarily storing data, a timer circuit, peripheral circuits of these and the like. The ADF control unit 700 constitutes a feed controller 701, a last sheet pickup detector 702, an abnormality detector 703, an abnormality resolution determiner 704 and the retraction controller 705. Note that, without being limited to the example in which the ADF control unit 700 is provided separately from the main control unit 100, the main control unit 100 and the ADF control unit 700 may be integrally configured.

The feed controller 701 causes documents Pb placed on the document feed tray 17 to be fed to the document discharge tray 18 via the image reading position 80 by controlling the operations of the drive motor 70, the electromagnetic clutch 530 and the one-way clutch 56 based on a control signal from the main control unit 100 and detection signals from the leading end detection sensor 91, the trailing end detection sensor 92, the document presence sensor 93 and the cover open/close sensor 94.

The last sheet pickup detector 702 detects the completion of the pickup of all the documents Pb placed on the document feed tray 17 by the pickup roller 33. Specifically, the last sheet pickup detector 702 determines that the pickup of all the documents Pb placed on the document feed tray 17 by the pickup roller 33 has been completed and outputs a signal indicating the completion of the pickup of all the documents Pb by the pickup roller 33 to the retraction controller 705 when the trailing end of the document Pb is detected by the trailing end detection sensor 92 and the absence of the document Pb on the document feed tray 17 is detected by the document presence sensor 93.

The abnormality detector 703 detects a document jam when an abnormality occurs in the conveyance of the document Pb, for example, such as when the trailing end of the document Pb is not detected by the trailing end detection sensor 92 even after the elapse of a monitoring time set in advance after the detection of the leading end of the document Pb by the leading end detection sensor 91. When detecting the document jam, the abnormality detector 703 notifies the occurrence of the document jam to the main control unit 100. Then, the main control unit 100 causes the display unit 521 to display a message prompting the user to remove the document Pb jammed in the feeder main body 21 by opening the cover body 16.

For example, when the opening of the cover body 16 is detected by the cover open/close sensor 94 after a document jam is detected by the abnormality detector 703 and, then, the closing of the cover body 16 is detected by the cover open/close sensor 94, the abnormality resolution determiner 704 judges that the document jam has been resolved and outputs a signal indicating the resolution of the document jam to the retraction controller 705. This is because the document Pb is thought to have been removed by the user when the opening of the cover body 16 is detected by the cover open/close sensor 94 after the document jam is detected by the abnormality detector 703 and, then, the closing of the cover body 16 is detected by the cover open/close sensor 94. Further, this resolution of the document jam may be judged if no document Pb is detected by the leading end detection sensor 91, the trailing end detection sensor 92 and the like when the opening of the cover body 16 is detected by the cover open/close sensor 94 after the document jam is detected by the abnormality detector 703 and, then, the closing of the cover body 16 is detected by the cover open/close sensor 94. Note that the abnormality resolution determiner 704 outputs a signal indicating the resolution of an abnormality to the retraction controller 705 when a certain abnormality, not limited to the sheet jam, is resolved.

The retraction controller 705 performs a retraction holding process (1) when the power switch 201 is turned on and the copier 1 is started, (2) when the placement of documents Pb on the document feed tray 17 (a change from a state where the documents Pb are absent to a state where the documents Pb are present) is detected by the document presence sensor 93, (3) when the pickup of all the documents Pb placed on the document feed tray 17 by the pickup roller 33 (the pickup of the last document Pb) is detected by the last sheet pickup detector 702 and (4) when the resolution of an abnormality such as a sheet jam is judged by the abnormality resolution determiner 704.

The retraction holding process is a process for setting the supporting body 31 to the retracting posture by setting the electromagnetic clutch 530 in the engaged stage (in an excited state) and rotating the drive motor 70 in the reverse direction, subsequently stopping the rotation of the drive motor 70 and setting the electromagnetic clutch 530 in the disengaged state (in a non-excited state) when an engagement keeping time Tw set in advance elapses after the rotation of the drive motor 70 is stopped.

Note that the retraction controller 705 needs not perform the retraction holding process at all of the above timings (1) to (4) and may perform the retraction holding process at some of the above timings (1) to (4) or at timings other than the above timings (1) to (4).

Figure 13:
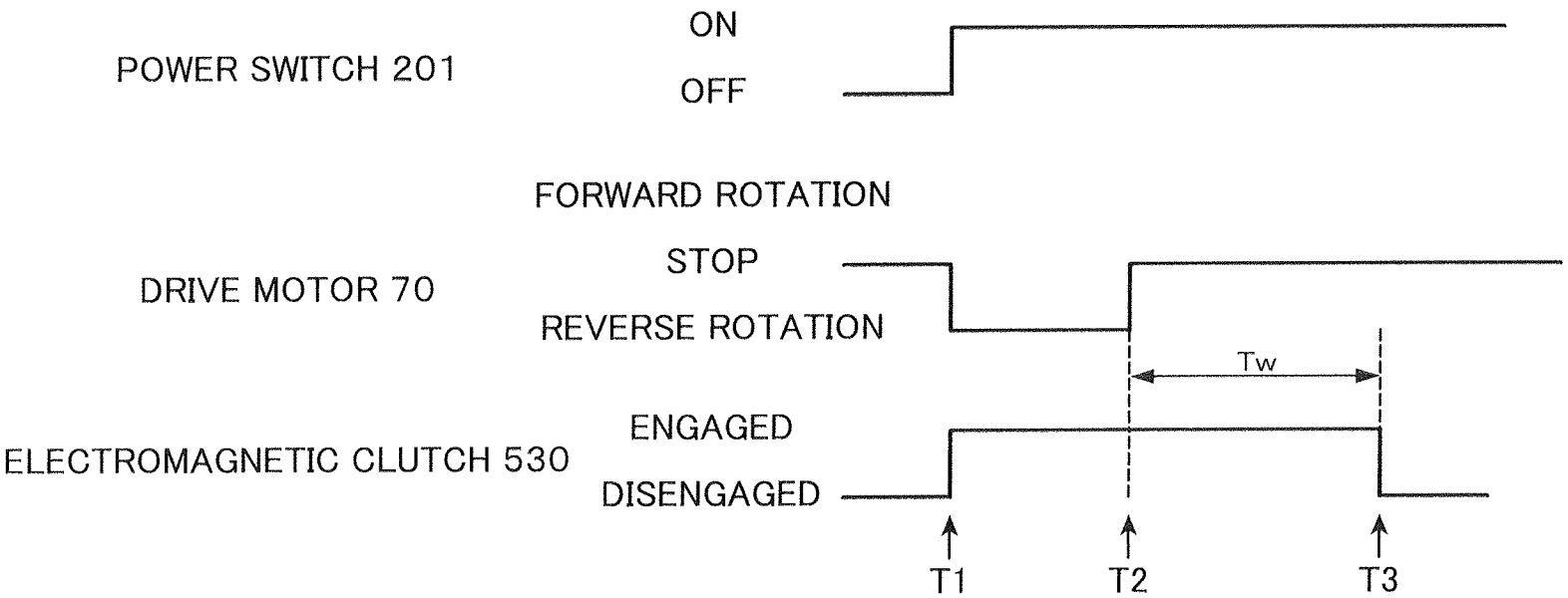
FIG. 13 is a timing chart showing an example of an operation when the copier shown in FIG. 1 is started.

Next, the operation of the auto document feeder 7 configured as described above is described. FIG. 13 is a timing chart showing an example of an operation when the copier 1 shown in FIG. 1 is started. For example, when the user turns on the power switch 201, the copier 1 is started and the ADF control unit 700 starts operating. Then, the retraction controller 705 performs the retraction holding process from timing T1 to timing T3.

In the retraction holding process, the retraction controller 705 first causes the electromagnetic clutch 530 to be engaged and the drive motor 70 to rotate in the reverse direction. As a result, the supporting body 31 is set to the retracting posture (timing T1).

The retraction controller 705 stops the rotational drive force of the drive motor 70 (timing T2) after the drive motor 70 is rotated in the reverse direction for a preset short time necessary to set the supporting body 31 to the retracting posture. Then, the supporting body 31 is held in the retracting posture.

Since the pickup roller 33 is retracted upward when the supporting body 31 is set to the retracting posture, the user can easily place (set) documents Pb on a predetermined position of the document feed tray 17. Further, since the stoppers 40 are fixed at the document contact position (FIG. 4) as described above when the supporting body 31 is set to the retracting posture, the user can easily reset the documents Pb by pressing a stack of documents Pb against the stopper pieces 42 to align the leading end edge of the stack of documents Pb.

Since the user turns on the power switch 201 for image formation by the copier 1, there is a high possibility that the user sets or resets documents Pb on the document feed tray 17 immediately after the power switch 201 is turned on. Thus, user convenience is improved if the retraction holding process is performed when the power switch 201 is turned on.

However, since a current needs to continuously flow to keep the electromagnetic clutch 530 in the engaged state, power consumption increases if the electromagnetic clutch 530 is kept in the engaged state. Accordingly, the retraction controller 705 cuts off the supply of the current to the electromagnetic clutch 530 to disengage the electromagnetic clutch 530 (timing T3) when the engagement keeping time Tw elapses after the rotational drive force of the drive motor 70 is stopped. In this way, power consumption by the electromagnetic clutch 530 is reduced.

Here, if the electromagnetic clutch 530 should be simultaneously disengaged at the timing T2 at which the rotational drive force of the drive motor 70 is stopped, a load acting on the feed roller gear 34*a* is eliminated. Thus, the supporting body 31 may turn from the retracting posture toward the sheet feeding posture and the pickup roller 33 may be lowered under the weight of the pickup roller 33, the gears 34 and the like or due to vibration or the like generated when the user resets the documents Pb. Further, if the supporting body 31 turns from the retracting posture toward the sheet feeding posture, the engaging pieces 43 of the stoppers 40 are disengaged from the first inclined surfaces 61 of the projections 60 and the stoppers 40 are no longer fixed.

If the pickup roller 33 is lowered or the stoppers 40 are no longer fixed, user convenience is impaired.

However, there is a high possibility that the user sets documents Pb on the document feed tray 17 within a certain limited time after the power switch 201 is turned on. Even if the supporting body 31 is not always held in the retracting posture after the elapse of that time, user convenience is less likely to be impaired.

Accordingly, the retraction controller 705 cuts off the supply of the current to the electromagnetic clutch 530 to disengage the electromagnetic clutch 530 when the engagement keeping time Tw elapses after the rotational drive force of the drive motor 70 is stopped (timing T3). In this way, power consumption by the electromagnetic clutch 530 can be reduced while a likelihood of impairing user convenience is reduced. For example, a time of about 10 seconds during which the user is thought to reset the documents Pb or align the leading end edge of the stack of documents Pb is set as the engagement keeping time Tw.

Figure 14:
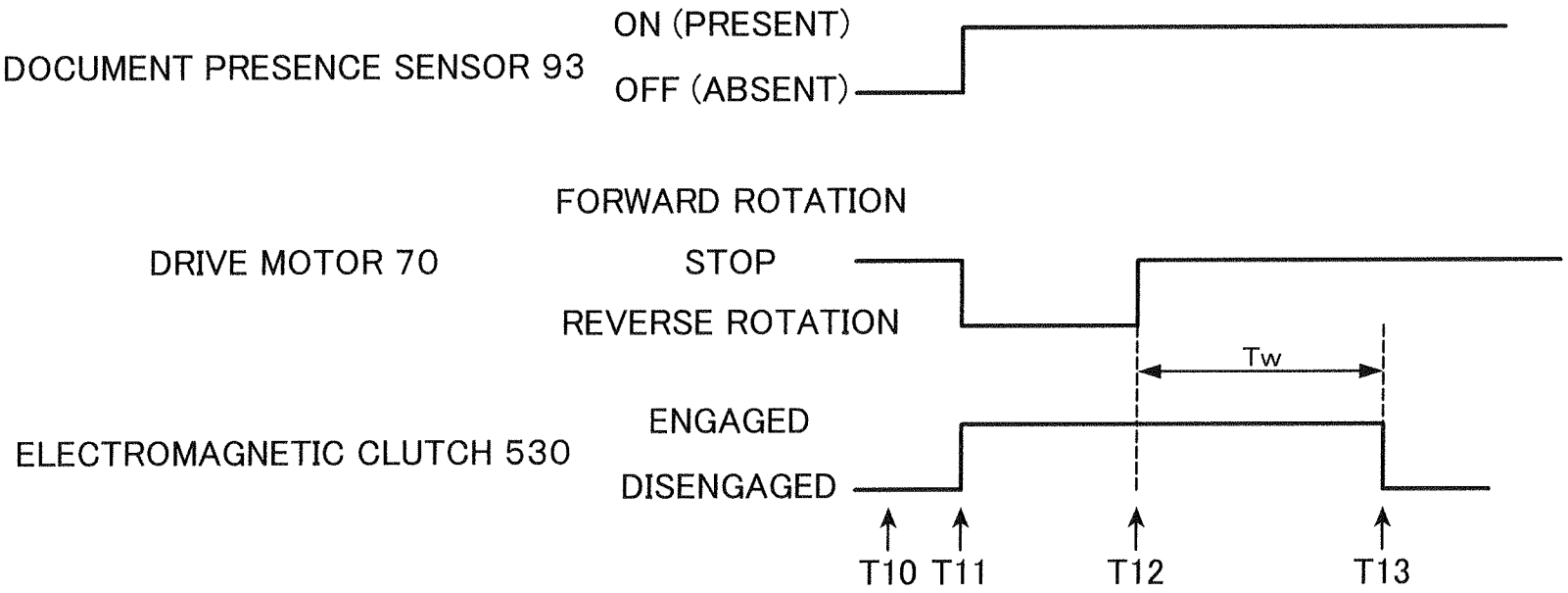
FIG. 14 is a timing chart for explaining the operation of a retraction controller when a user sets documents.

Incidentally, the user does not turn on the power switch 201 every time when reading (coping) documents. The user may set documents Pb when the copier 1 is already set in a standby state by turning on the power switch 201. FIG. 14 is a timing chart for explaining the operation of the retraction controller 705 in such a case.

First, in the standby state of the copier 1, the drive motor 70 is stopped and the electromagnetic clutch 530 is disengaged (timing T10). At this time, the document presence sensor 93 is off since no document Pb is placed on the document feed tray 17. The following description is made, assuming that the leading end detection sensor 91, the trailing end detection sensor 92 and the document presence sensor 93 are turned off when detecting the absence of the document while being turned on when detecting the presence of the document. Note that the on-states of the leading end detection sensor 91, the trailing end detection sensor 92 and the document presence sensor 93 may correspond to the absence of the document and the off-states thereof may correspond to the presence of the document.

When the user sets the documents Pb on the document feed tray 17, the document presence sensor 93 changes from off to on. A change from off to on of the document presence sensor 93 indicates the placement of the documents Pb on the document feed tray 17.

Then, when the document presence sensor 93 changes from off to on, the retraction controller 705 performs a retraction holding process similar to the one performed from timing T1 to timing T3 described above (timing T11 to timing T13). In this way, power consumption by the electromagnetic clutch 530 can be reduced while a likelihood of impairing user convenience is reduced as in the case described above.

There is a high possibility that the user resets documents Pb or align an end surface of a document stack (sheet stack) in placing the documents Pb (sheet) on the document feed tray 17 (sheet placing portion). Thus, according to this configuration, the retraction holding process by the retraction controller 705 is performed at a timing at which the placement of the documents Pb on the document feed tray 17 is detected by the document presence sensor 93 (sheet detector), i.e. there is a high possibility that the user resets the documents Pb or aligns the end surface of the document stack. As a result, the convenience of the user to set the documents Pb or align the end surface of the document stack can be improved.

The documents Pb are set on the document feed tray 17 in this way, and the user enters a predetermined input such as the number of print copies on the operation panel unit 520 (FIG. 1) and successively turns on an unillustrated start key. The turn-on of this start key is detected by the main control unit 100, a control signal is output from the main control unit 100 to the ADF control unit 700 and a drive signal is output from the feed controller 701 to the drive motor 70. In this way, the drive motor 70 starts rotating in the forward direction (counterclockwise rotation in FIG. 10, indicated by arrows).

This forward rotation of the drive motor 70 is transmitted to the feed roller gear 34*a* via the drive gear 51, the center gear 52, the first intermediate gear 53, the electromagnetic clutch 530 and the second intermediate gear 53*b*. It is further transmitted from the feed roller gear 34*a* to the pickup roller gear 34*b* via the intermediate gear 34*c*, whereby the feed roller gear 34*a* and the pickup roller gear 34*b* respectively rotate clockwise.

Note that, instead of interposing the intermediate gear 34*c* between the feed roller gear 34*a* and the pickup roller gear 34*b*, an endless belt such as a timing belt may be mounted between the feed roller gear 34*a* and the pickup roller gear 34*b* (actually pickup roller pulley) and the rotation of the feed roller gear 34*a* may be transmitted to the pickup roller pulley via this endless belt.

Then, when the feed roller gear 34*a* rotates clockwise, the feed roller 32 integral to the feed roller gear 34*a* also rotates clockwise and the supporting body 31 held in contact with the feed roller gear 34*a* via the coil spring 38 (FIG. 9) also rotates clockwise about the long shaft 35. In this way, the pickup roller 33 is set to the sheet feeding posture where it presses the upper surface of the uppermost document Pb of the document stack as shown in FIG. 5. In this state, slip occurs between the coil spring 38 and the side plate 31*b* of the supporting body 31, whereby any further turning movement of the sheet feeding member 30 is prevented and the pickup roller 33 presses the documents Pb with a predetermined pressure.

Accordingly, the uppermost document Pb of the document stack moves toward the downstream side (left side in FIG. 5) to press the stopper pieces 42 by being guided by the clockwise rotation of the pickup roller 33 about the short shaft 36. At this time, the stoppers 40 are set in a free state due to the disengagement of the engaging pieces 43 from the first inclined surfaces 61 of the projections 60 since the sheet feeding member 30 is in the sheet feeding posture. As a result, the stoppers 40 rotate clockwise about the cross shafts 44 by being pushed by the leading end of the document Pb moving toward the downstream side and are shifted to the document passage allowing position as shown by chain double-dashed line in FIG. 6.

In this way, the document Pb slips under the lower ends of the stopper pieces 42 and reaches the feed roller 32, moves toward the downstream side while being guided by the rotation of the feed roller in the state sandwiched between the feed roller 32 and the slide-contact element 25 and is introduced into the arcuate guiding space 14*c*. The feed of the document Pb toward the registration roller 27 by driving the feed roller 32 is referred to as primary feed.

Note that the auto document feeder 7 may not include the stoppers 40.

On the other hand, as shown in FIG. 10, the forward drive rotation of the drive motor 70 is also transmitted to the registration gear 55 via the drive gear 51, the center gear 52 and the third intermediate gear 54 and this registration gear 55 rotates clockwise about the registration gear shaft 55*a*. At this time, the one-way clutch 56 is disengaged and the registration roller 27 is in a stopped state.

Then, when the leading end of the document Pb moving in the arcuate guiding space 14*c* while being guided by the drive rotation of the feed roller 32 reaches the nip position between the registration roller 27 and the first idle roller 281, the leading end detection sensor 91 detects it and a detection signal thereof is input to the ADF control unit 700 to be described later. When this detection signal is input, the ADF control unit 700 outputs a drive signal for rotating the drive motor 70 in the reverse direction (clockwise rotation about the drive shaft 71) to the drive motor 70 and outputs a control signal for disengaging the electromagnetic clutch 530.

Since this causes the registration roller 27 to rotate counterclockwise about the registration roller shaft 27*a* via the registration gear 55 and the one-way clutch 56, the document Pb whose leading end is located at a position of registration is guided by the rotation of the registration roller 27, has a document image read by the scanner unit 510 while being guided by the first paper guide 291 and passing through the clearance between the circumferential surface of the registration roller 27 and the document reading slit 514, and is subsequently discharged toward the document discharge tray 18 through the document discharge opening 14*b* along the discharge path 14*d* after being guided by the second paper guide 292 as shown in FIG. 7. Note that the feed of the document Pb toward the image reading position 80 by the rotation of the registration roller 27 is referred to as secondary feed.

Then, when the trailing end of the document Pb is detected by the trailing end detection sensor 92, i.e. the discharge of the document Pb through the document discharge opening 14*b* is completed, the feed controller 701 causes the electromagnetic clutch 530 to be engaged and the drive motor 70 to rotate in the forward direction based on a detection signal of the trailing end detection sensor 92. Then, the second document Pb is fed toward the image reading position 80 by an operation similar to the above.

Here, if the document presence sensor 93 is off, i.e. the absence of the document Pb on the document feed tray 17 is detected by the document presence sensor 93 when the trailing end of the document Pb is detected by the trailing end detection sensor 92, the last sheet pickup detector 702 detects the completion of the pickup of all the documents Pb placed on the document feed tray 17 by the pickup roller 33 and outputs a detection signal thereof to the retraction controller 705. Then, the retraction controller 705 performs the retraction holding process.

According to this configuration, the long shaft 35 (rotary shaft) is rotated by a forward rotational drive force transmitted from the drive motor 70 (motor) via the electromagnetic clutch 530, the rotation thereof is transmitted to the pickup roller 33 (feeding member) by the intermediate gear 34*c* (rotational drive transmitter) to rotate the pickup roller 33, and the document Pb (sheet) on the document feed tray 17 (sheet placing portion) is picked up by that rotation. Further, when the long shaft 35 is rotated in the reverse direction by a reverse rotational drive force transmitted from the drive motor 70 via the electromagnetic clutch 530, this reverse rotational drive force is transmitted to the coil spring 38 (drive force transmitter) to change the posture of the supporting body 31 to the retracting posture. Thus, the retraction controller 705 can set the supporting body 31 to the retracting posture by causing the electromagnetic clutch 530 to be engaged and the drive motor 70 to rotate in the reverse direction in the retraction holding process. In this way, the pickup of the document Pb (sheet) by the pickup roller 33 and the posture change of the supporting body 31 can be performed by one motor.

Figure 15:
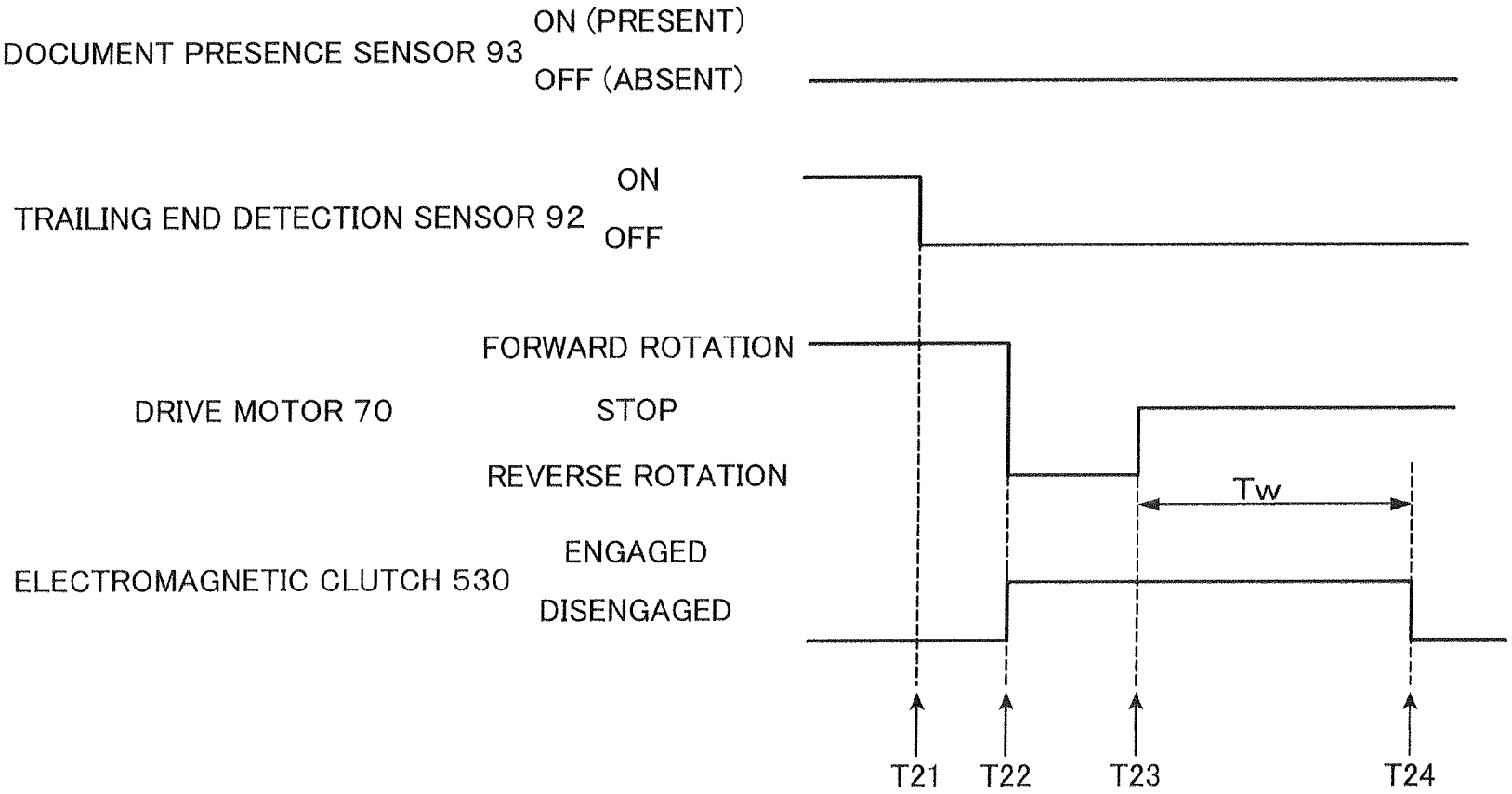
FIG. 15 is a timing chart for explaining a retraction holding process when the completion of the pickup of all documents by a pickup roller is detected by a last sheet pickup detector.

FIG. 15 is a timing chart for explaining the retraction holding process when the completion of the pickup of all the documents Pb by the pickup roller 33 is detected by the last sheet pickup detector 702.

First, when the trailing end of the last one of the documents Pb placed on the document feed tray 17 passes the trailing end detection sensor 92, the trailing end detection sensor 92 changes from on to off (timing T21). Specifically, the trailing end detection sensor 92 is turned off after being turned on, thereby detecting the trailing end of the document Pb.

The last sheet pickup detector 702 confirms the state of the document presence sensor 93 at timing T21 at which the trailing end detection sensor 92 is turned off after being turned on. If the document presence sensor 93 is off at timing T21, it means that the document Pb discharged to the document discharge tray 18 after passing the trailing end detection sensor 92 is the last document. Thus, the last sheet pickup detector 702 determines the completion of the pickup of all the documents Pb placed on the document feed tray 17 by the pickup roller 33 and outputs a signal indicating the completion of the pickup of all the documents Pb by the pickup roller 33 to the retraction controller 705.

When receiving the signal indicating the completion of the pickup of all the documents Pb by the pickup roller 33, the retraction controller 705 performs the retraction holding process similar to the one performed from timing T1 to timing T3 described above (from timing T22 to timing T24).

As just described, when all the documents Pb placed on the document feed tray 17 are picked up by the pickup roller 33, there is a high possibility that the user tries to place new documents Pb on the document feed tray 17. In this way, by the retraction controller 705 performing the retraction holding process at the timing at which there is a high possibility that the user tries to place new documents Pb on the document feed tray 17, power consumption by the electromagnetic clutch 530 can be reduced while a likelihood of impairing user convenience is reduced as in the case described above.

Note that although the drive force for setting the supporting body 31 to the retracting posture by rotating the feed roller 32 (long shaft 35) in the reverse direction and that for conveying the document Pb by the registration roller 27 are both obtained from the reverse rotational drive force of the drive motor 70 in the above example, the drive force for conveying the document Pb by the registration roller 27 may be obtained from the forward rotational drive force of the drive motor 70.

Further, the motor for driving the registration roller 27 may be provided separately from the drive motor 70. Further, another conveying mechanism different from the registration roller 27 may be provided as a conveying means for the documents Pb and the another conveying mechanism may be drived by a motor different from the drive motor 70.

In the case of providing a motor for generating a drive force for conveying the document Pb at a side downstream of the feed roller 32 separately from the drive motor 70 for rotating the feed roller 32 (long shaft 35) in the reverse direction, the drive motor 70 may be stopped until timing T22 after the feed of the document Pb is finished by rotating the feed roller 32 in the forward direction. Further, in such a case, the last sheet pickup detector 702 may be configured to output a signal indicating the completion of the pickup of all the documents Pb by the pickup roller 33 to the retraction controller 705 when the absence of the document Pb on the document feed tray 17 is detected by the document presence sensor 93 regardless of the detection operation of the trailing end detection sensor 92.

Figure 16:
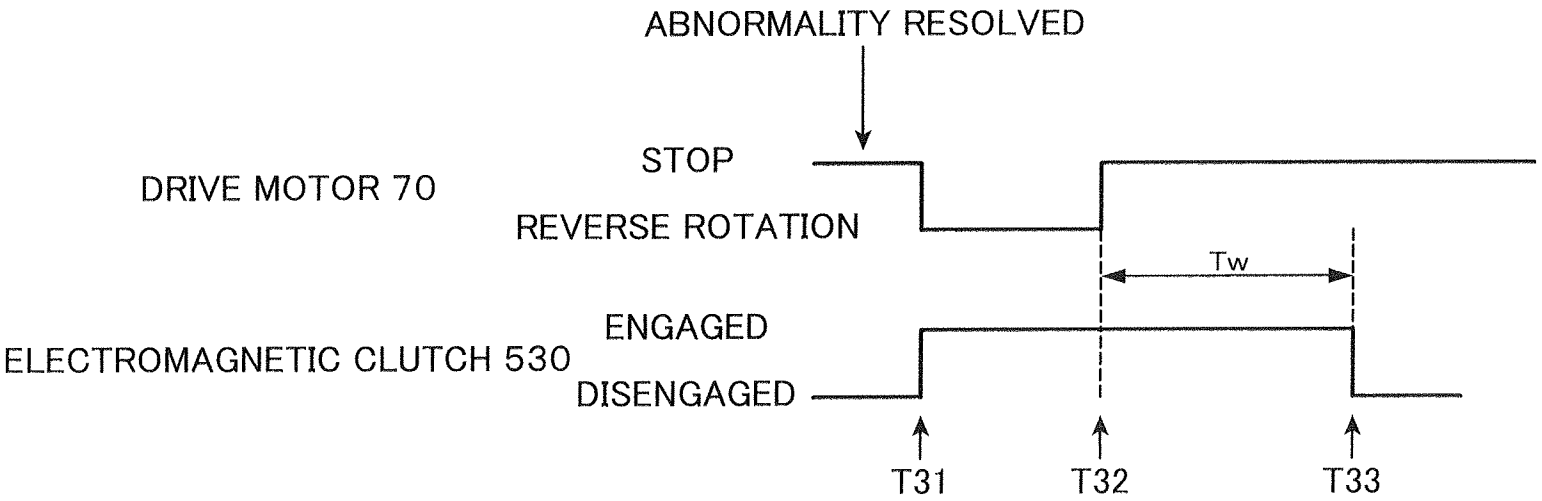
FIG. 16 is a timing chart for explaining the retraction holding process when the resolution of an abnormality is judged by an abnormality resolution determiner.

Further, there is a high possibility that the user tries to reset the documents Pb on the document feed tray 17 also when a certain abnormality is resolved such as when a document jam having occurred in the feeder main body 21 is resolved. Accordingly, as shown in FIG. 16, the retraction controller 705 performs a retraction holding process similar to the one performed from timing T1 to T3 described above from timing T31 to timing T3 also when the resolution of an abnormality is judged by the abnormality resolution determiner 704. By the retraction controller 705 performing the retraction holding process at a timing at which there is a high possibility that the user tries to reset the documents Pb on the document feed tray 17 in this way, power consumption by the electromagnetic clutch 530 can be reduced while a likelihood of impairing user convenience is reduced as in the case described above.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A sheet feeder, comprising:

a sheet placing portion on which a sheet is to be placed;

a feeding member that picks up a sheet from the sheet placing portion;

a supporting body that supports the feeding member and capable of changing a posture between a sheet feeding posture for bringing the feeding member into contact with the upper surface of a sheet placed on the sheet placing portion and a retracting posture for retracting the feeding member upward relative to the sheet feeding posture;

a driver that outputs a drive force for changing the posture of the supporting body to the retracting posture against a gravitational force;

an electromagnetic clutch capable of changing a state between an engaged state in which a drive force output from the driver is transmitted to the supporting body and a disengaged state in which the drive force is not transmitted to the supporting body; and a retraction controller that performs a retraction holding process for switching the supporting body to the retracting posture;

wherein the retraction holding process is a process for stopping the output of a drive force by the driver after the electromagnetic clutch is set in the engaged state and the supporting body is set to the retracting posture by the drive force from the driver and setting the electromagnetic clutch in the disengaged state when an engagement keeping time set in advance elapses after the output of the drive force is stopped.

2. A sheet feeder according to claim 1, further comprising a last sheet pickup detector that detects the completion of the pickup of all sheets placed on the sheet placing portion by the feeding member, wherein the retraction controller performs the retraction holding process when the completion of the pickup of all the sheets is detected by the last sheet pickup detector.

3. A sheet feeder according to claim 1, further comprising a sheet detector that detects the placement of the sheet on the sheet placing portion, wherein the retraction controller performs the retraction holding process when the placement of the sheet on the sheet placing portion is detected by the sheet detector.

4. A sheet feeder according to claim 1, further comprising:

a conveyor that conveys a sheet picked up from the sheet placing portion by the feeding member;

an abnormality detector that detects the occurrence of an abnormality in the conveyance of the sheet by the conveyor; and an abnormality resolution determiner that judges whether or not an abnormality detected by the abnormality detector has been resolved;

wherein the retraction controller performs the retraction holding process when the resolution of the abnormality is judged by the abnormality resolution determiner.

5. A sheet feeder according to claim 1, further comprising a power switch that switches on and off the supply of power to the sheet feeder from a power supply;

wherein the retraction controller performs the retraction holding process when the power switch is turned on.

6. A sheet feeder according to claim 1, further comprising:

a rotary shaft supported by the supporting body in parallel to an axial direction about which the feeding member is rotated and that is driven and rotated by a drive force transmitted from the driver via the electromagnetic clutch;

a rotational drive transmitter that transmits the rotation of the rotary shaft to the feeding member; and a drive force transmitter that transmits a rotational drive force of the rotary shaft to the supporting body and change the posture of the supporting body to the retracting posture by transmitting the rotational drive force of the rotary shaft, which force rotates the feeding member in an opposite direction to a direction in which the sheet is picked up, to the supporting body;

wherein:

the driver is a motor; and the retraction controller sets the electromagnetic clutch in the engaged state and causes the motor to rotate in a direction to generate the rotational drive force of the rotary shaft, which force rotates the feeding member in the opposite direction when the supporting body is set to the retracting posture in the retraction holding process.

7. An image processing apparatus, comprising:

a sheet feeder according to claim 1; and a processor for performing a predetermined processing using a sheet picked up by the feeding member.

* * * * *